US006305791B1

(12) United States Patent
Hotomi et al.

(10) Patent No.: US 6,305,791 B1
(45) Date of Patent: Oct. 23, 2001

(54) INK-JET RECORDING DEVICE

(75) Inventors: Hideo Hotomi, Nishinomiya; Keishi Sawada; Yasuhiro Sando, both of Amagasaki; Kusunoki Higashino, Osaka; Naoki Matsui, Sakai, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 08/904,412

(22) Filed: Jul. 31, 1997

(30) Foreign Application Priority Data

| | | |
|---|---|---|
| Jul. 31, 1996 | (JP) | 8-201773 |
| Aug. 1, 1996 | (JP) | 8-203530 |
| Aug. 1, 1996 | (JP) | 8-203542 |
| Jan. 14, 1997 | (JP) | 9-004552 |
| Jan. 20, 1997 | (JP) | 9-007420 |
| Feb. 14, 1997 | (JP) | 9-030125 |
| Feb. 14, 1997 | (JP) | 9-030128 |
| Feb. 26, 1997 | (JP) | 9-041858 |

(51) Int. Cl.[7] ..... B41J 2/045
(52) U.S. Cl. ..... 347/70
(58) Field of Search ..... 347/68–71, 72, 347/43, 50, 40; 29/890.1; 399/261; 361/700; 310/328–330

(56) References Cited

U.S. PATENT DOCUMENTS

| | | | | |
|---|---|---|---|---|
| 4,546,362 | * | 10/1985 | Koto . | |
| 4,682,216 | * | 7/1987 | Sasaki et al. | 347/43 |
| 4,697,193 | * | 9/1987 | Howkins | 347/70 |
| 5,208,605 | | 5/1993 | Drake . | |
| 5,270,740 | * | 12/1993 | Naruse et al. | 347/70 |
| 5,412,410 | | 5/1995 | Rezanka . | |
| 5,446,485 | | 8/1995 | Usui et al. . | |
| 5,754,205 | * | 5/1998 | Miyata et al. | 347/70 |
| 5,761,783 | * | 6/1998 | Osawa et al. | 347/70 |
| 5,818,482 | * | 10/1998 | Ohta et al. | 347/70 |

* cited by examiner

*Primary Examiner*—John Barlow
*Assistant Examiner*—Raquel Yvette Gordon
(74) *Attorney, Agent, or Firm*—Sidley & Austin

(57) ABSTRACT

An ink-jet recording device (1) comprises a first wall member or partition (24*a*) adjacent to an ink material (38*a*) and a second wall member or partition (24*b*) adjacent to an ink material (38*b*). An elasticity of the first wall member (24*a*) is different from that of the second wall member (24*b*). Arranged adjacent to the first and second wall members (24*a*, 24*b*) are first and second piezoelectric members (34), respectively. Once the piezoelectric members (34) are biased, they deform to force the adjacent ink materials through the wall members (24*a*,24*b*), ejecting ink droplets of different sizes. This ensures the ink-jet recording head to print a halftone image with a high gradation.

48 Claims, 38 Drawing Sheets

Fig.6

| TEST NO. | | MATERIAL | ELASTICITY (kgf/mm²) | THICKNESS (μ m) | DOT DIAMETER (MAX-MIN) (μ m) | |
|---|---|---|---|---|---|---|
| | | | | | SMALL DOT | LARGE DOT |
| 1 | SMALL DIAMETER | SUS#304 | 170,000 | 15 | 25-62 | |
| | LARGE DIAMETER | Ni | 140,000 | 10 | | 34-96 |
| 2 | SMALL DIAMETER | Ni | 137,000 | 12 | 38-101 | |
| | LARGE DIAMETER | ARAMID FILM (TORAY) | 34,000 | 10 | | 45-112 |
| 3 | SMALL DIAMETER | ARAMID FILM | 32,000 | 18 | 47-120 | |
| | LARGE DIAMETER | PHENYLENESULFIDE | 29,000 | 9 | | 50-122 |
| 4 | SMALL DIAMETER | ARAMID FILM | 31,000 | 25 | 50-125 | |
| | LARGE DIAMETER | POLYIMIDE (TORAY) | 25,000 | 12 | | 58-132 |
| 5 | SMALL DIAMETER | ARAMID FILM | 31,000 | 12 | 50-125 | |
| | LARGE DIAMETER | ARAMID FILM | 28,000 | 6 | | 55-130 |

INK-JET RECORDING DEVICE

FIELD OF THE INVENTION

The present invention relates to an ink-jet recording device for reproducing an image by ejecting ink droplets onto a sheet substrate such as plain paper and an ink-jet recording method thereof.

BACKGROUND OF THE INVENTION

There have been known a variety of ink-jet recording devices for ejecting ink droplets onto a sheet substrate to reproduce an image thereon. To print a high quality image in a short period of time using such ink-jet recording device, it has been understood that a tone reproduction in which a plurality sizes of ink dots are deposited on the sheet substrate is effective. For this toner reproduction, an ink-jet recording device including two types of nozzles, i.e., large size nozzles and small size nozzles, are proposed in the art.

The technique is useful to some extend, however, a variation range of diameters of the dots formed on the sheet substrate is restricted. This in turn restricts a tone reproduction range by the recording device. In particular, for a printing of the halftone image such as picture to which a greater tone reproductivity has been required, the known technique could not provide a satisfactory tone gradation. Also, for ejecting small and large ink droplets, the technique needs both small diameter nozzles and large diameter nozzles to be formed in a head portion of the device, which renders the device costly.

Another ink-jet recording device is known in the art in which a plurality of ink materials having different colors of different properties, respectively, are deposited on the same place to superimpose the dots of different colors for the purpose of reproducing a colorful image on the sheet substrate. In such full color ink-jet printer, the ink droplets of different colors ejected on the same ejecting condition are desired to have a certain diameter. However, because each of the color ink materials has independent property, it is unavoidable that the ink droplets ejected under the same ejecting condition have different diameters. One possible method to overcome this problem is to provide nozzles of different sizes for respective colors, but this increases the cost of the recording device as described above.

SUMMARY OF THE INVENTION

Accordingly, a primary object of the invention is to provide an improved ink-jet recording device and an improved ink-jet recording method for use in the ink-jet recording device.

Another object of the invention is to provide an ink-jet recording device and an ink-jet recording method capable of controlling sizes of ink droplets to be ejected.

Accordingly, in the ink-jet recording head of the invention, each head portion is provided with an independent structure in terms of an elasticity of a partition interposed between a piezoelectric member and ink material, a thickness of the partition, a dimension of the piezoelectric member, a polarization of the piezoelectric member, or the like. Due to this, the ink droplet ejected from one head portion is different in size from that ejected from the other head portions. This ensures the ink-jet recording head to print a halftone image with a higher gradation.

BRIEF DESCRIPTION OF THE DRAWINGS

A preferred embodiment of the invention is described below by referring to the drawings in which:

FIG. 6 is a table showing the result of the tests made for the first embodiment;

DETAILED DESCRIPTION OF THE PREFERRED EMBODIMENTS

Ink-Jet Recording Device

Figure 1:
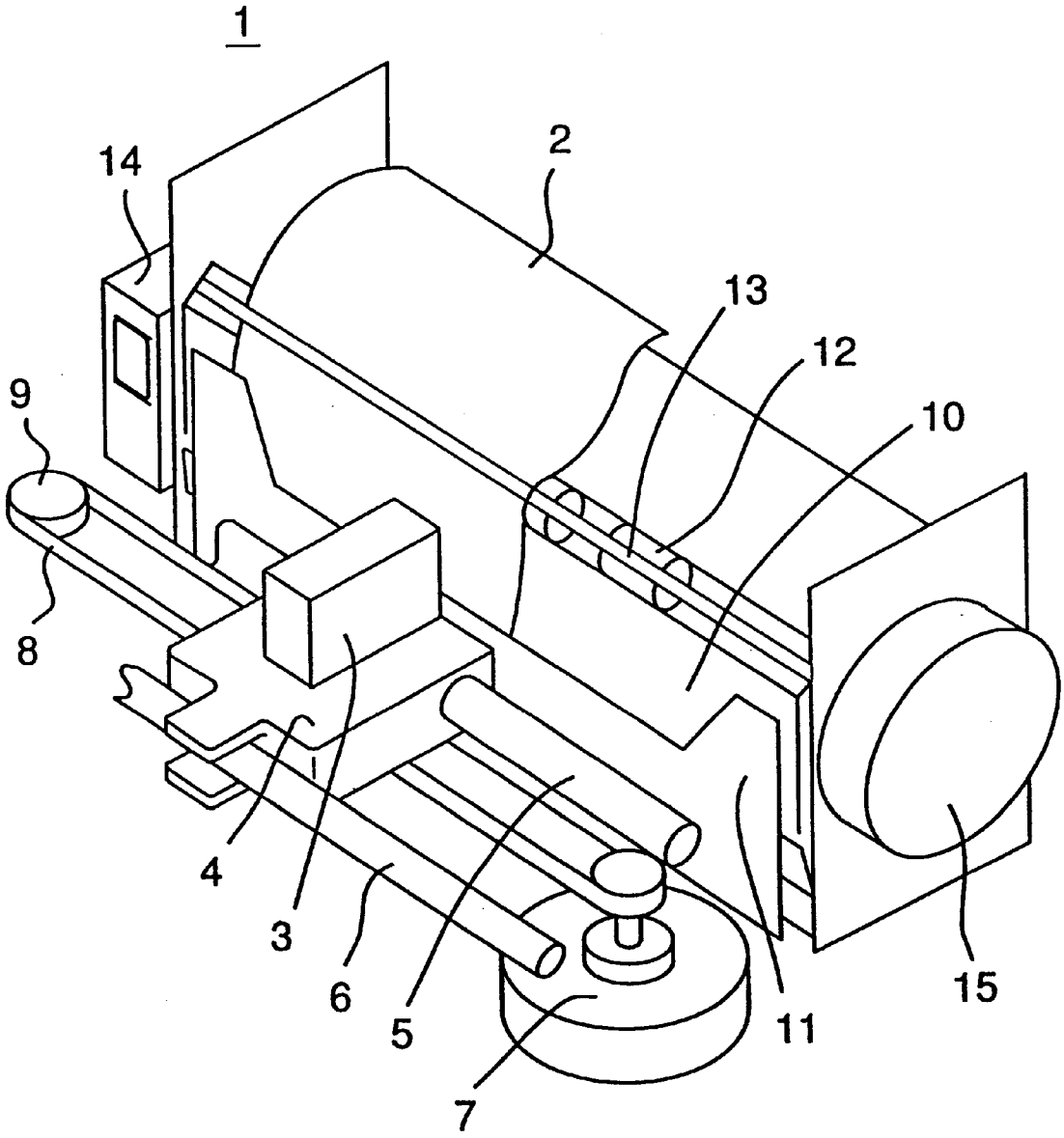
FIG. 1 is a perspective view of an ink-jet recording device of the invention in which a housing is eliminated.

With reference to the drawings, particularly in FIG. 1, an ink-jet recording device, generally indicated by reference numeral 1, for printing an image on a recording medium or sheet 2 such as plain paper, includes an ink-jet recording head 3 for printing the image on the recording sheet 2, a carriage 4 for supporting the ink-jet recording head 3, two parallel rods 5 and 6 for guiding the carriage 4 in an oscillating fashion above the recording sheet 2, a drive motor 7 for moving the carriage 4 along the rods 5 and 6, a timing belt 8 transforming the rotation of the drive motor 7 into the oscillating movement of the carriage 4, and an idle pulley 9 supporting the belt 8.

The ink-jet recording device 1 further includes a platen 10 for guiding the recording sheet 2 along a predetermined passage, a plate 11 for bringing the recording sheet in close contact with the platen 10, a discharge roller 12 for discharging the recording sheet, a guide roller 13 for guiding the recording sheet with the discharge roller 12, a recovery mechanism 14 for recovering a good ejection of the ink-jet recording head 13, and a knob 15 for feeding the recording sheet 2 by the manual rotation thereof.

The recording sheet 2 is fed by a sheet feeding mechanism (not shown) having a feed roller, such as cut-sheet feeder or manual feeder known in the art. At this moment, a time for rotating the feed roller is controlled so that the recording sheet is fed into a recording station with keeping a timed relationship with a printing of the ink-jet recording head 3.

In operation, the carriage 4 together with the ink-jet recording head 3 scans or travels in a transverse direction of the recording sheet 2 by the driving of the drive motor 7, idle pulley 8 and timing belt 9 so that a strip-like region on the recording sheet 2, extending in the transverse direction, is printed by the ink-jet recording head 3. After the completion of the scanning and printing, the recording sheet 2 is incremented in a direction perpendicular to the transverse direction for the subsequent scanning of the carriage 4 and ink-jet recording head 3.

Figure 2:
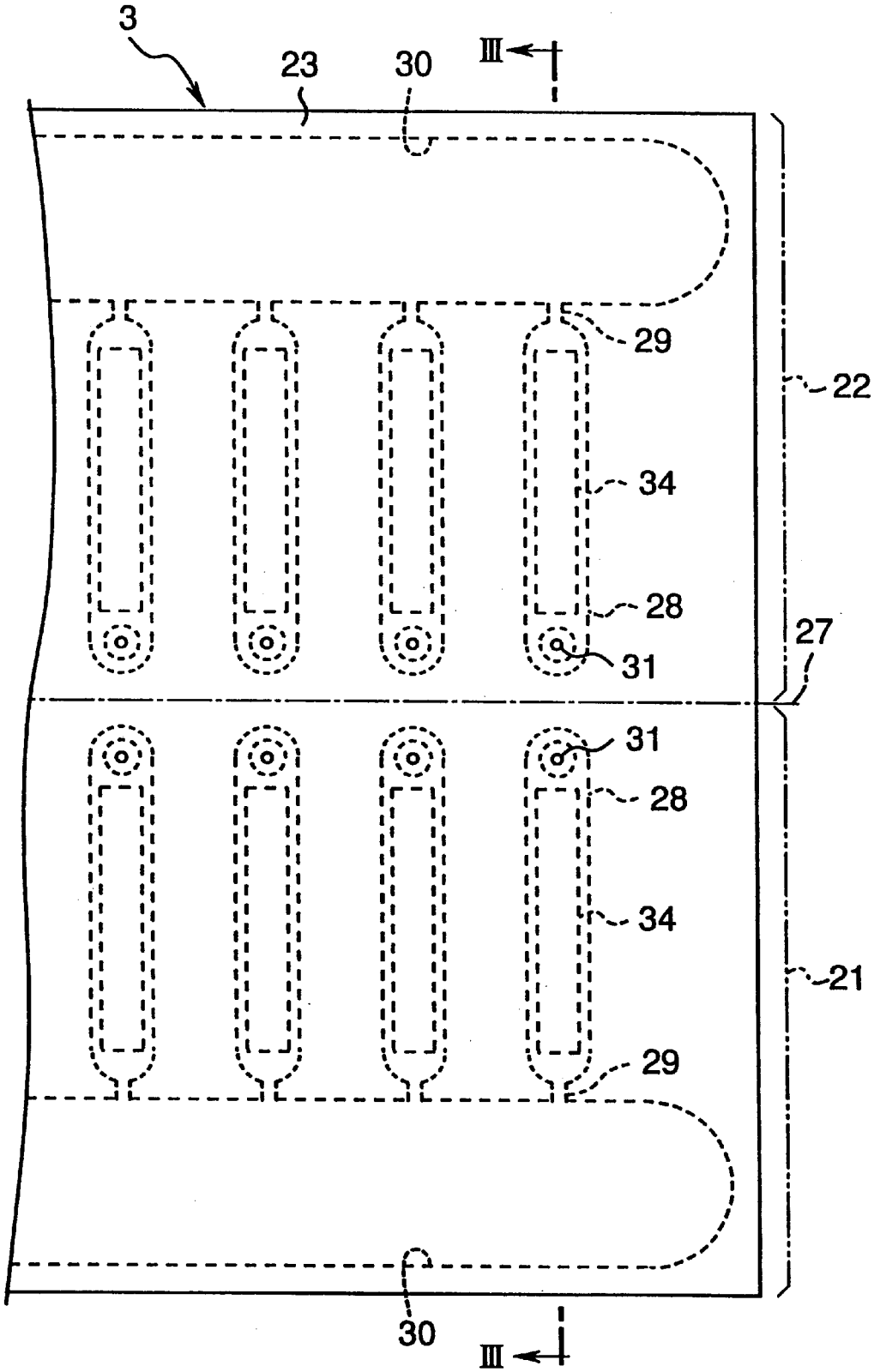
FIG. 2 is an enlarged plan view of the ink-jet recording head.
Figure 3:
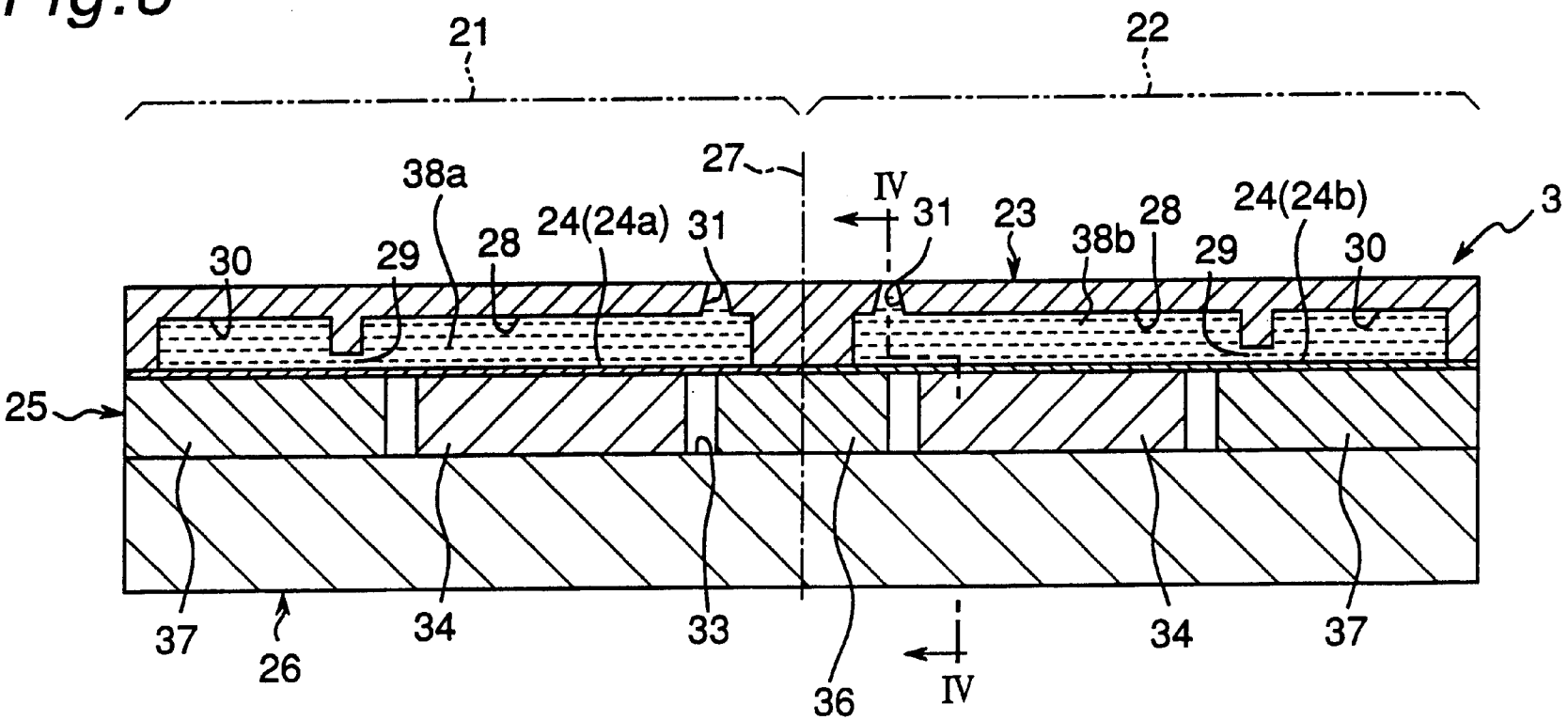
FIG. 3 is an enlarged cross sectional view of the ink-jet recording head taken along a line III—III in FIG. 2.
Figure 4:
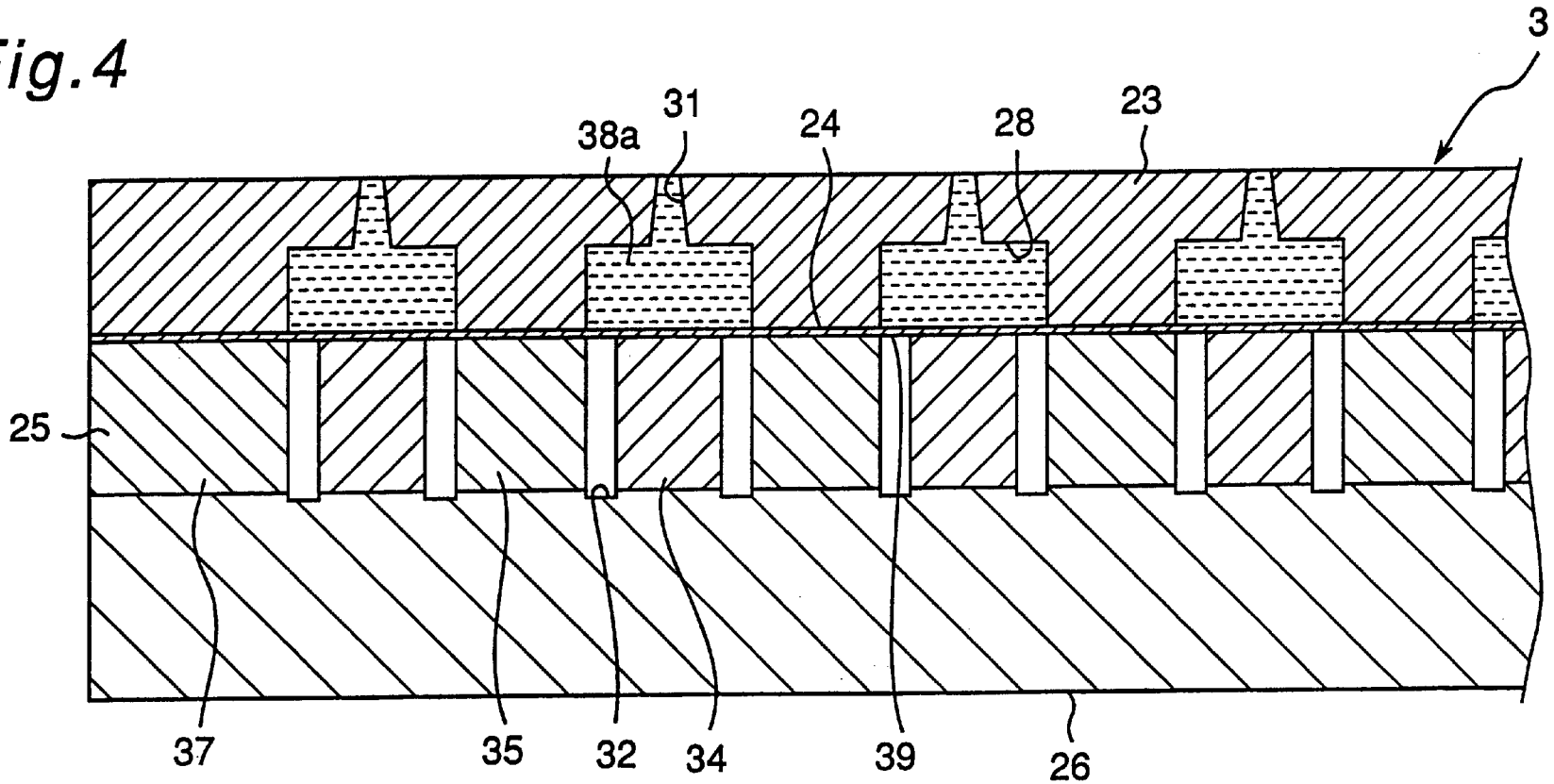
FIG. 4 is an enlarged cross sectional view of the ink-jet recording head taken along a line IV—IV in FIG. 3.

Referring to FIGS. 2 to 4, the ink-jet recording head 3 includes a first head portion generally indicated by reference numeral 21 for ejecting first ink droplets and a second head portion generally indicated by reference numeral 22 for ejecting second ink droplets smaller than the first ink droplets. The first and second head portions 21 and 22 are constructed by a cover plate 23, a diaphragm 24, intermediate plate 25 and a base plate 26 and arranged symmetrically with respect to a central imaginary line indicated by reference numeral 27.

The cover plate 23, which is a planar plate made of metal or resin, has a first surface (i.e., upper surface in FIG. 3) away from the diaphragm 24 and a second surface (i.e., lower surface in FIG. 3) adjacent the diaphragm 24. The second surface of the cover plate 23 includes a plurality of concave portions, symmetrically with respect to the central line 27, preferably formed by etching, lithography, or photolithography. The diaphragm 24, which is a thin plate made of metal or resin, is bonded on the second surface of cover plate 23 to cover the concave portions, thereby symmetrically forming a plurality of elongated ink cavities 28, ink inlets 29, and ink supply chambers 30, for the first and second head portions 21 and 22, respectively.

In each of the first and second head potions 21 and 22, the ink cavities 28 are arranged parallel to each other and fluidly communicated with the ink supply chamber 30 through associated ink inlets 29 so that a ink material provided in the ink supply chamber 30 can be supplied to the ink cavities 28. The cover plate 23 also has a plurality of nozzles 31 fluidly communicating the ink cavities 28 to the atmosphere for ejecting the ink material in the ink cavities 28 through respective nozzles 31. The nozzle 31 is arranged adjacent one end of the ink cavity 28 away from the ink inlet 29, along an imaginary line (not shown) extending perpendicular to a longitudinal axis of the ink cavity 28. Preferably, the nozzle 31 is in the form of truncated cone so that an inner diameter thereof increases successively towards the first surface, i.e., upper surface in FIG. 3.

Figure 5:
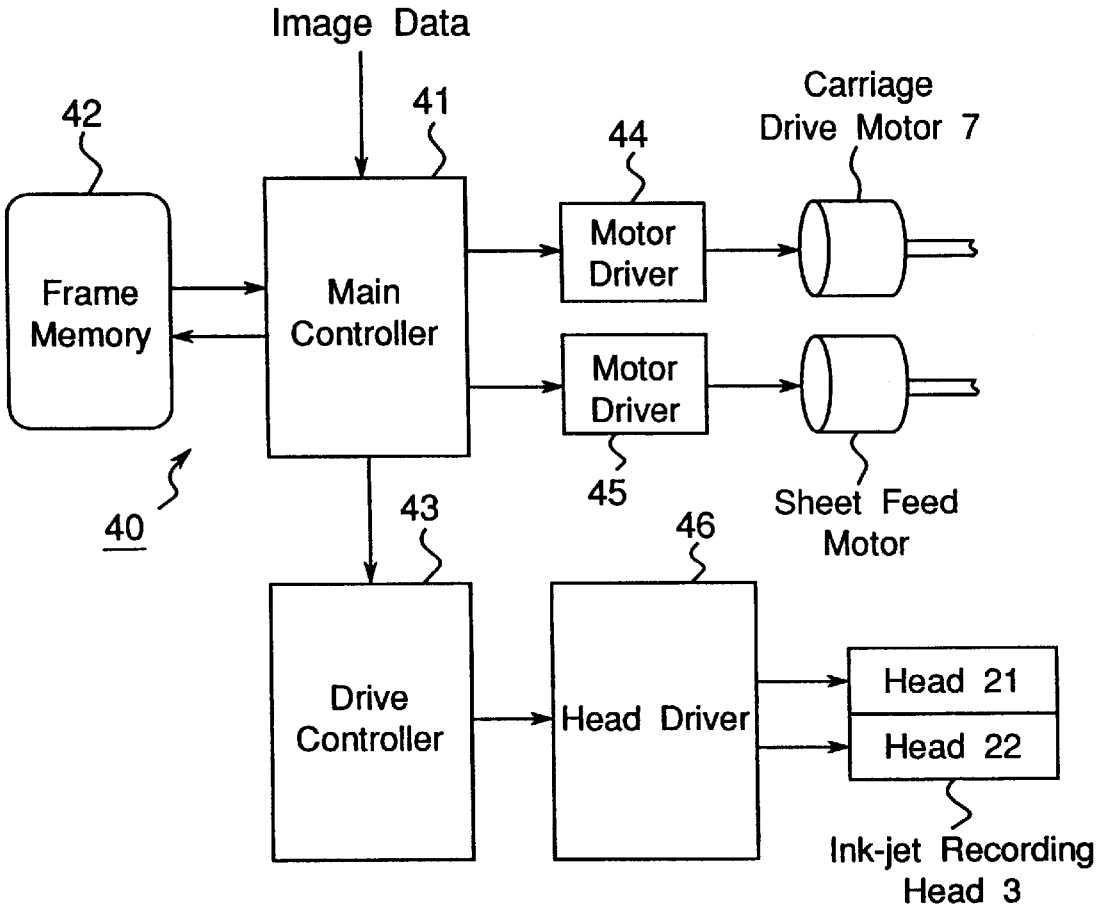
FIG. 5 is a block diagram of a control unit of the ink-jet recording device.
Figure 7:
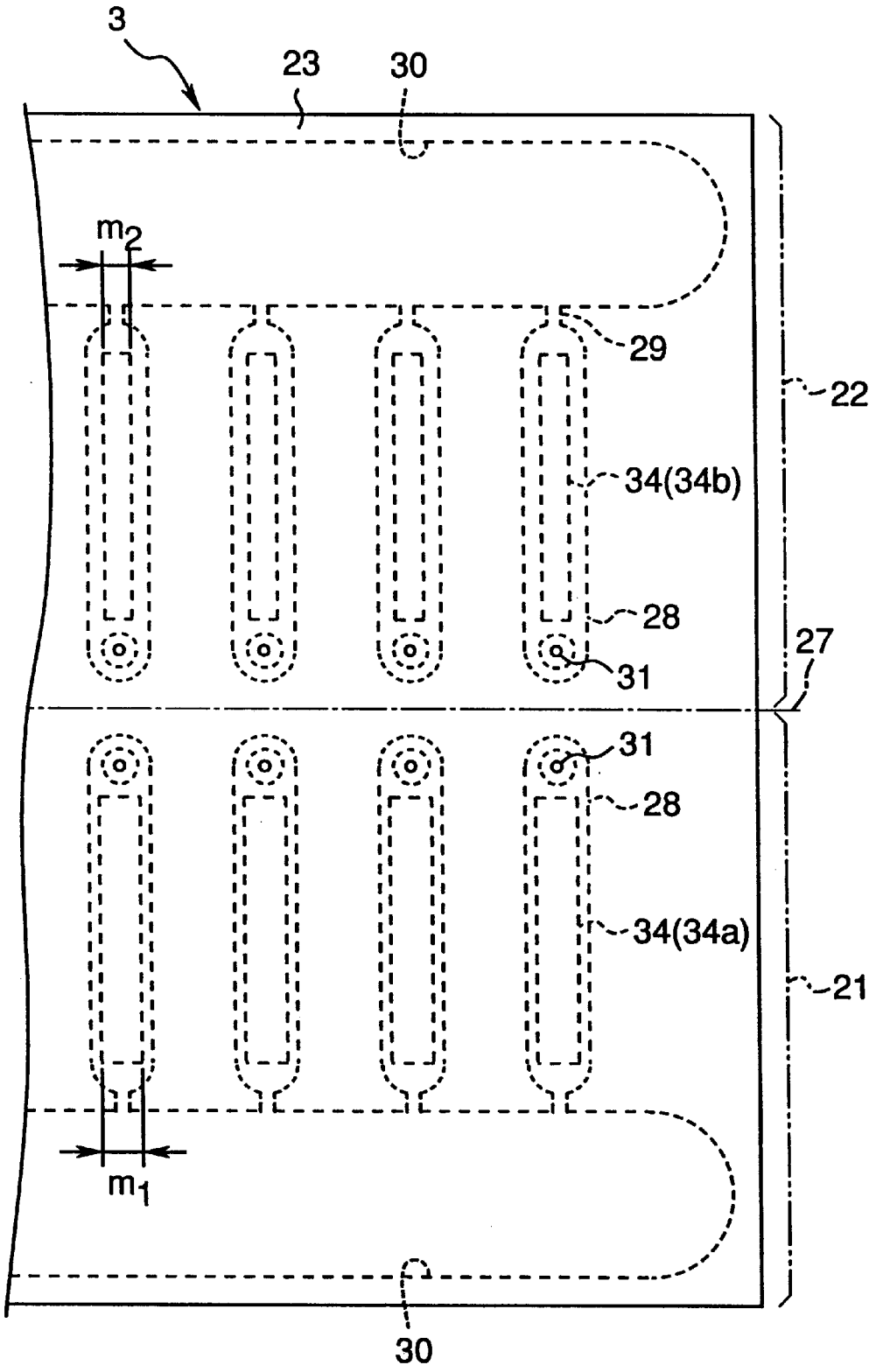
FIG. 7 is an enlarged plan view of the ink-jet head of the second embodiment.
Figure 8:
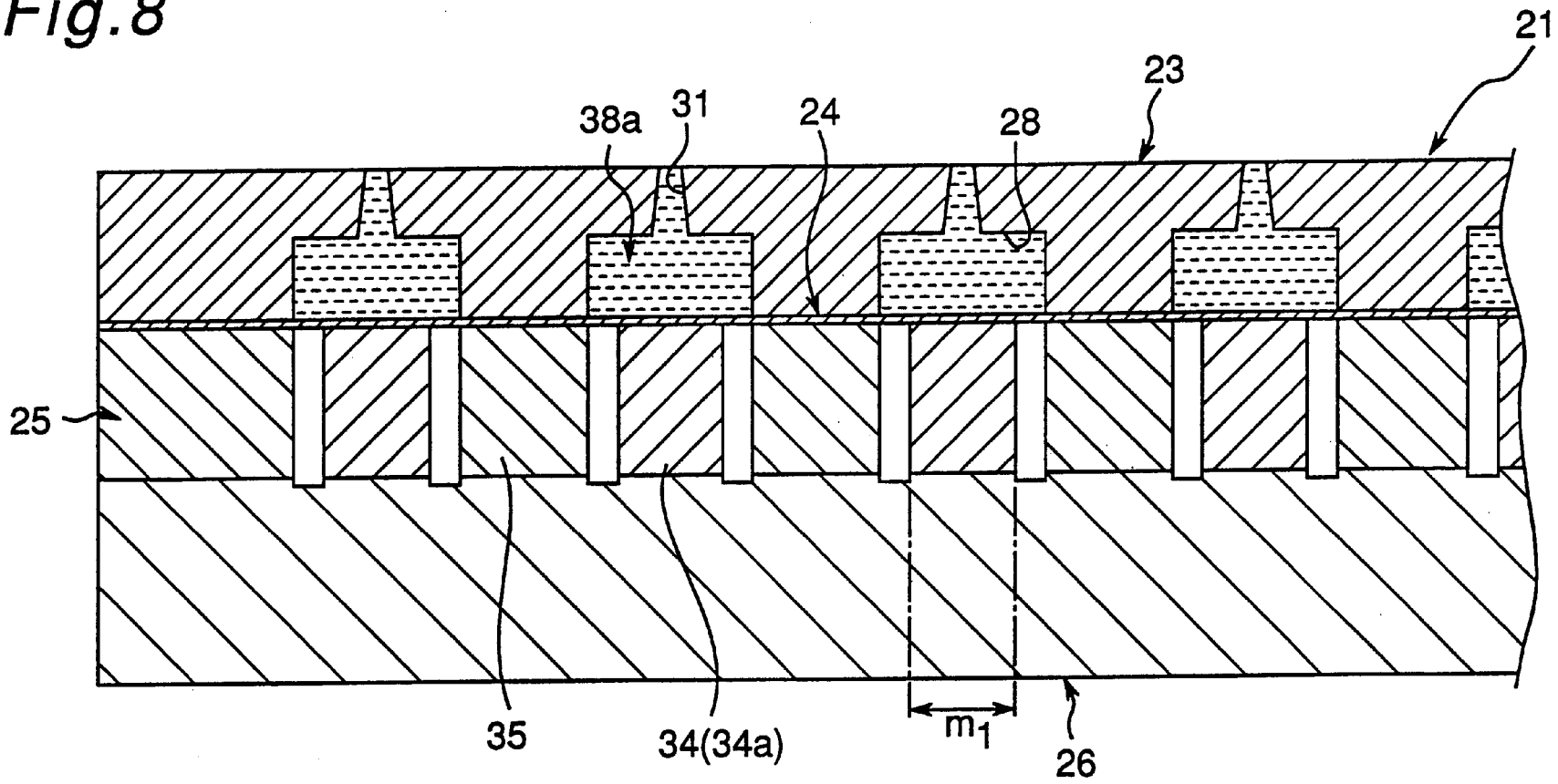
FIG. 8 is an enlarged cross sectional view of the ink-jet recording head shown in FIG. 7.
Figure 9:
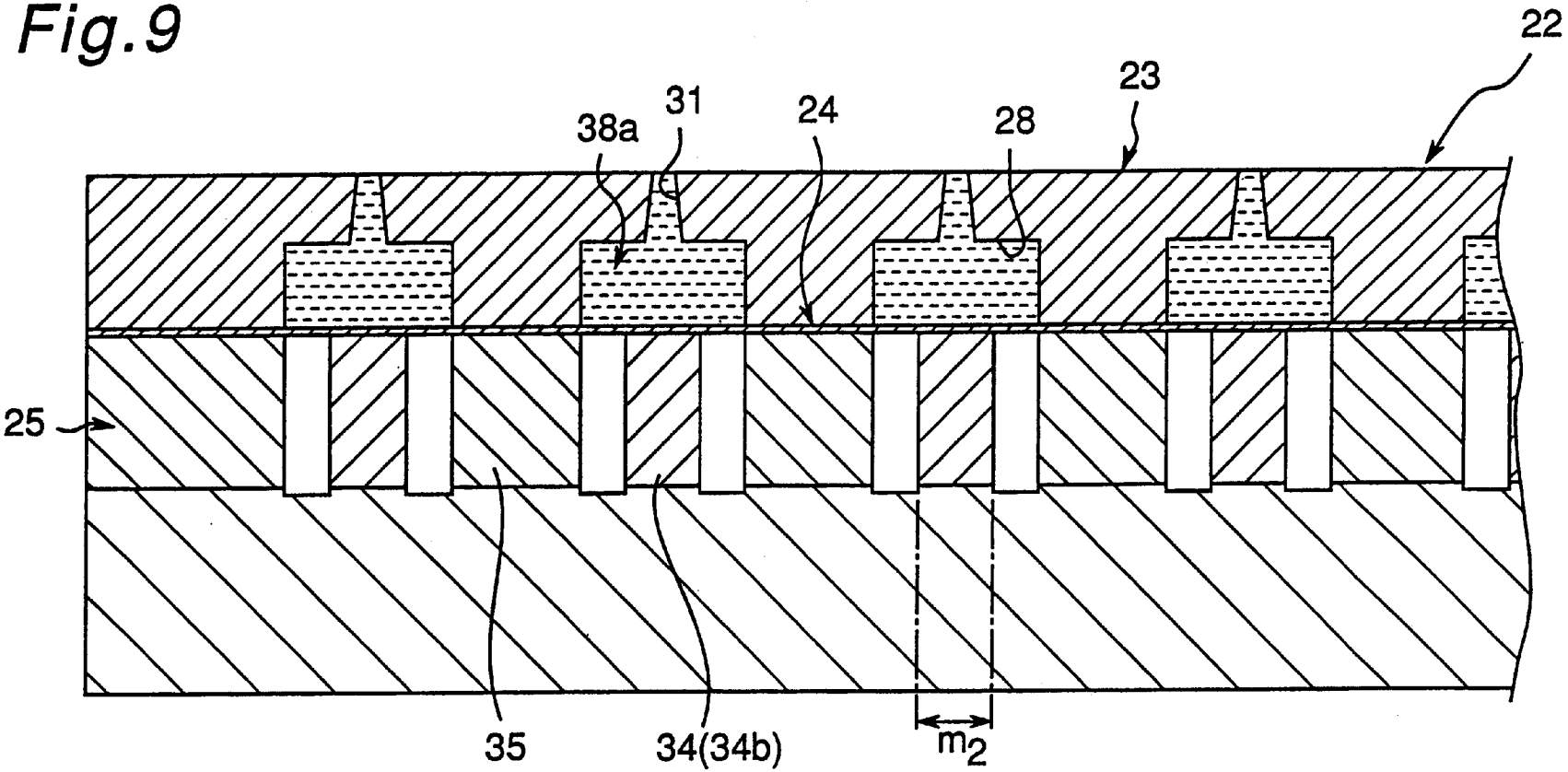
FIG. 9 is an enlarged cross sectional view of the ink-jet recording head shown in FIG. 8.

The intermediate plate 25, which is made of piece-electric materials, such as, lead zirconate and lead titanate, is secured between the diaphragm 24 and base plate 26. The intermediate plate 25 has conductive metal layers used as common and individual electrodes (not shown), respectively, on opposite surfaces confronting the diaphragm 24 and base plate 26, respectively. The common and individual electrodes are electrically communicated with a control unit as shown in FIG. 5 so that a certain voltage is applied between the electrodes in response to image signal corresponding to an image to be printed. It is to be understood that the electrodes can be communicated with the control unit in various manner. For example, if the diaphragm 24 is made of electrically conductive material, the diaphragm 24 may be used as the common electrode. Also, the connecting line for the individual electrode may be patterned on the base plate 26.

The intermediate plate 25 is divided by grooves 32 extending along the elongated ink cavity 28 and grooves 33 extending perpendicular to the ink cavity 28, preferably formed by a dicing, into piezoelectric members 34, partitions 35 between neighboring piezoelectric members 34, a central partition 36 extending along the central line 27 between the first and second head portions 21 and 22, and peripheral walls 37 surrounding the piezoelectric members 34 and the like. The piezoelectric member 34 is polarized by the application of a high voltage between the associated common and individual electrodes under an elevated temperature so that it can deform when a voltage is applied between the associated common and individual electrodes. The piezoelectric member 34 may be a single layer piezoelectric plate or a multi-layered piezoelectric plate in which a plurality of conductive layers and piezoelectric material layers are superimposed alternately.

The base plate 26, which is preferably made of ceramic, metal, or resin material, is bonded on the intermediate plate 25.

Control Unit

Referring to FIG. 5, there is shown a control unit generally indicated by reference numeral 40. The control unit 40 includes a main controller 41 for receiving image data from an output such as computer. The main controller 41 is communicated with a frame memory 42, drive controller 43, and motor drivers 44 and 45. The drive controller 43 is in turn communicated with a head driver 46 for transmitting image signals to first and second head portions 21 and 22. The motor drivers 44 and 45 are further communicated with carriage drive motor 7 and paper feed motor, respectively.

Operation

In operation of the control unit 40, the image data is transmitted from the output to the main controller 41. The image data is stored per one frame of image in the frame memory 42. At printing, the main controller 41 instructs the motor drivers 44 and 45 to drive the carriage drive motor and sheet feed motor. Thereby, the ink-jet recording head 3 together with the carriage 4 is scanned while the recording sheet 2 is transported as shown in FIG. 1. In addition, the main controller 41 reads the image date stored in the frame memory 52 to instruct the drive controller 43 and then head driver 46 to drive the piezoelectric members 34 in the first and second head portions 21 and 22.

In the ink-jet printing head 3, first and second ink materials 38*a* and 38*b* are contained in the ink supply chambers 30 in the first and second head portions 21 and 22, respectively. Each of the ink materials 38*a* and 38*b* is supplied to the ink cavities 28 through the ink inlets 29. When a pulse corresponding to the image data is applied from the head driver 56, the piezoelectric member 34 is energized to expand instantaneously toward the diaphragm 24. With this expansion, the diaphragm 24 is forced towards the ink cavity 28 to pressurize the ink material contained therein. As a result, the ink droplet is ejected through the nozzle 31. Then, the ejected ink droplet is deposited on the recording sheet 2 to form the ink dot thereon, thereby reproducing an image on the recording sheet 2.

Halftone Reproduction

Discussions will be made to a reproduction of a halftone image by the ink-jet recording device 1.

First Embodiment

To reproduce a halftone image, the recording head 3 is so designed that both elasticity and thickness of the diaphragm 24*a* in the first head portion 21 are different from, i.e., greater than, those of the diaphragm 24*b* of the second head portion 22.

In this instance, when applying an image signal having a certain voltage between the common and individual electrodes on opposite surfaces of piezoelectric members 34 in the first and second head portions 21 and 22, the ink droplet ejected from nozzle 31 in the first head portion 21 is greater than that from the nozzle 31 in the second head portion 22. Due to this, by selecting first or second head portions 21 or 22 and further changing the voltage to be applied between the common and individual electrodes according to the image to be reproduced, the halftone reproductivity can be varied in a wide range to thereby form a picture-like image with a smooth color gradation.

A diameter of the nozzle 31 in the first head portion 21 may be larger than that in the second head portion 22, which ensures a wider range of halftone reproductivity.

Also, the diaphragms of different materials may be selected for first and second head portions 21 and 22 to stabilize the ejection of the ink droplets.

Further, the diaphragm of the same material may be used for first and second head portions 21 and 22 for reducing the manufacturing cost of the recording device. In this instance, separate elasticities can be provided for respective diaphragms by changing the thicknesses thereof.

Test was conducted to evaluate the diameters of dots deposited on the recording sheet using a variety of films for the diaphragm of the first and second head portions. In the tests, the ink-jet recording head shown in FIGS. 2 to 4 were employed. The cover was cut from an electrocast product of nickel. The ink cavity was 4,000 micron meters long, 160 micron meters width, and 80 micron meters depth. The ink inlet was 200 micron meters long, 40 micron meters width, and 40 micron meters depth. The nozzles were spaced at 250 micron meters. The nozzle was formed that the inner diameter adjacent the ink cavity was 25 micron meters and the taper angle was 10 degrees. The thickness of the cover was 150 micron meters. The piezoelectric member, 3,000 micron meters long, 600 microns thickness, and 100 micron meters width, was cut from a laminated piezoelectric member consisting of 20 thin piezoelectric plates each having thickness of 25 micron meters. The pulse applied to the piezoelectric member was varied from 2 to 65 volts, and the pulse duration was changed from 1 to 100 micron seconds. The ink material used was obtained under the trade designation "T-1003 (Bk)" from DIC (DAINIPPON INK AND CHEMICALS, INC.). The recording sheet was obtained under trade designation "SF paper" from EPSON.

The results are illustrated in FIG. 6 which shows that the first and second head portions have separate variation ranges of sizes of ink droplet and resultant ink dot due to the difference in elasticity or thickness thereof even if other conditions are the same. Therefore, simply by using diaphragms, each having individual elasticity and/or thickness, for first and second head portions, respectively, the dot size can be varied so widely to form a good halftone image.

Another test was conducted in which a width of a portion 39 of the diaphragm 24 between the piezoelectric member 34 and the neighboring partition 35 (see FIG. 4) was changed and the ink ejection was viewed. As a result, if the width is in the range of 10 to 80 micron meters, the ink droplets are effectively ejected. If the width is less than 10 micron meters or greater than 80 micron meters, the ink droplets are not ejected vigorously.

Second Embodiment

Referring to FIGS. 7 to 10, the piezoelectric members 34*a* and 34*b* of the first and second head portions 21 and 22 are so designed that the width m1 of the piezoelectric member 34*a* is greater than the width m2 of the piezoelectric member 34*b*. However, the piezoelectric members 34*a* and 34*b* have the same length and thickness. The widths can be adjusted by changing the width of the groove between the piezoelectric member and the neighboring partition at dicing process.

Therefore, when applying the same voltage to the piezoelectric members 34*a* and 34*b*, the diameter of the ink droplet from the first head portion 21 is greater than that from the second head portion 22. Also, a variation range of the diameters of ink droplet and the resultant dot by the first head portion 21 is greater than that by the second head portion 22.

In view of above, by selecting first or second head portions 21 or 22 and further changing the voltage to be applied between the common and individual electrodes according to the image to be reproduced, the halftone reproductivity can be varied in a wide rage to thereby form a picture-like image with a smooth color gradation.

It is to be understood that a diameter of the nozzle 31 in the first head portion 21 may be larger than that in the second head portion 22, which ensures a wider range of halftone reproductivity.

Tests were conducted to obtain the relationship between the diameter of the dot formed by the first and second head portions and the voltage applied to the piezoelectric members.

Test 1

The piezoelectric member, cut from a laminated piezoelectric member consisting of 20 thin piezoelectric plates each having thickness of 25 micron meters, was 4,000 micron meters long. An activating length of the piezoelectric member, capable of being activated by the application of voltage, was 3,000 micron meters long. The widths of the piezoelectric members for the first and second head portions was 200 micron meters and 150 micron meters, respectively. A film made of aramid resin, having a thickness of 6 micron meters, commercially available from TORAY CO. was used for the diaphragm. Coated papers obtained under trade designation "Sharp coated paper ST-70A4" were used. The ink material used was obtained under the trade designation "MAT-1002" from DIC (DAINIPPON IN AND CHEMICALS, INC.). The diameters of the nozzles in the first and second head portions were 35 micron meters. A pulse signal having pulse duration of 30 micron seconds was applied to the piezoelectric members.

Figure 10:
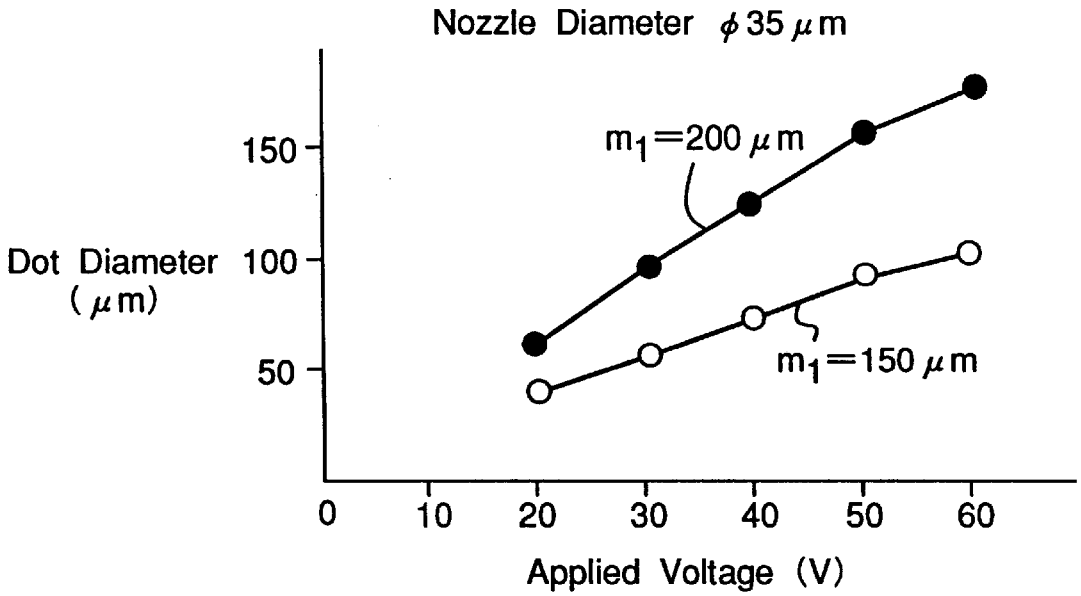
FIG. 10 is a graph showing the test result made for the ink-jet head of the second embodiment.

The result is illustrated in FIG. 10 which shows that under the same pulse voltage the ink dot formed by the first head portion with wide piezoelectric members are greater than those by the second head portion with narrow piezoelectric members.

Test 2

Figure 11:
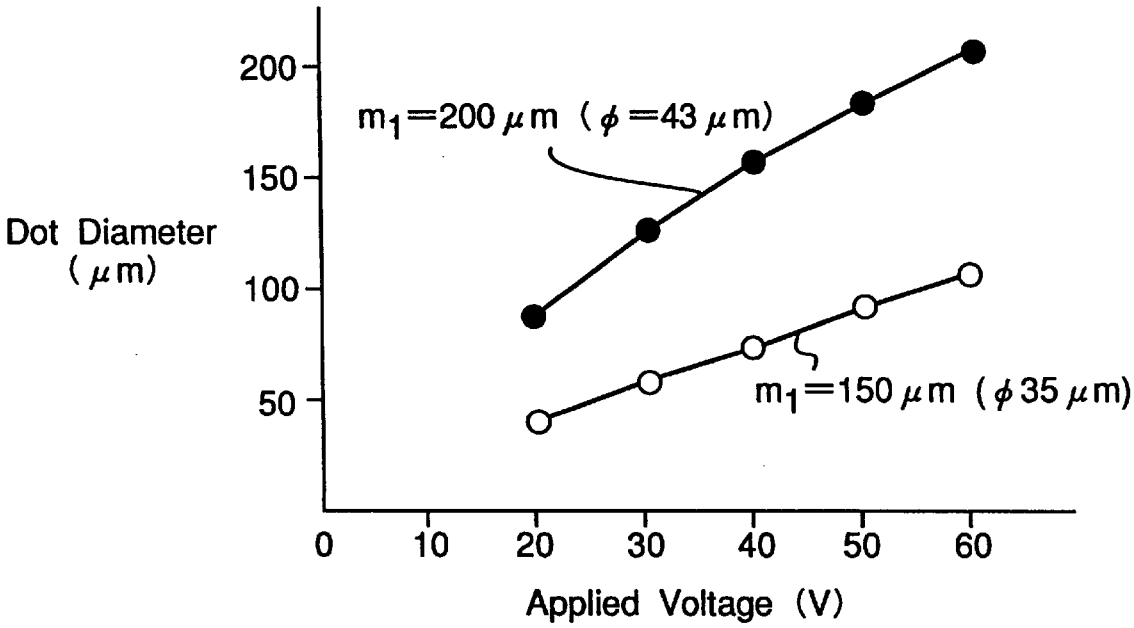
FIG. 11 is a graph showing the test result also made for the ink-jet head of the second embodiment.
Figure 12:
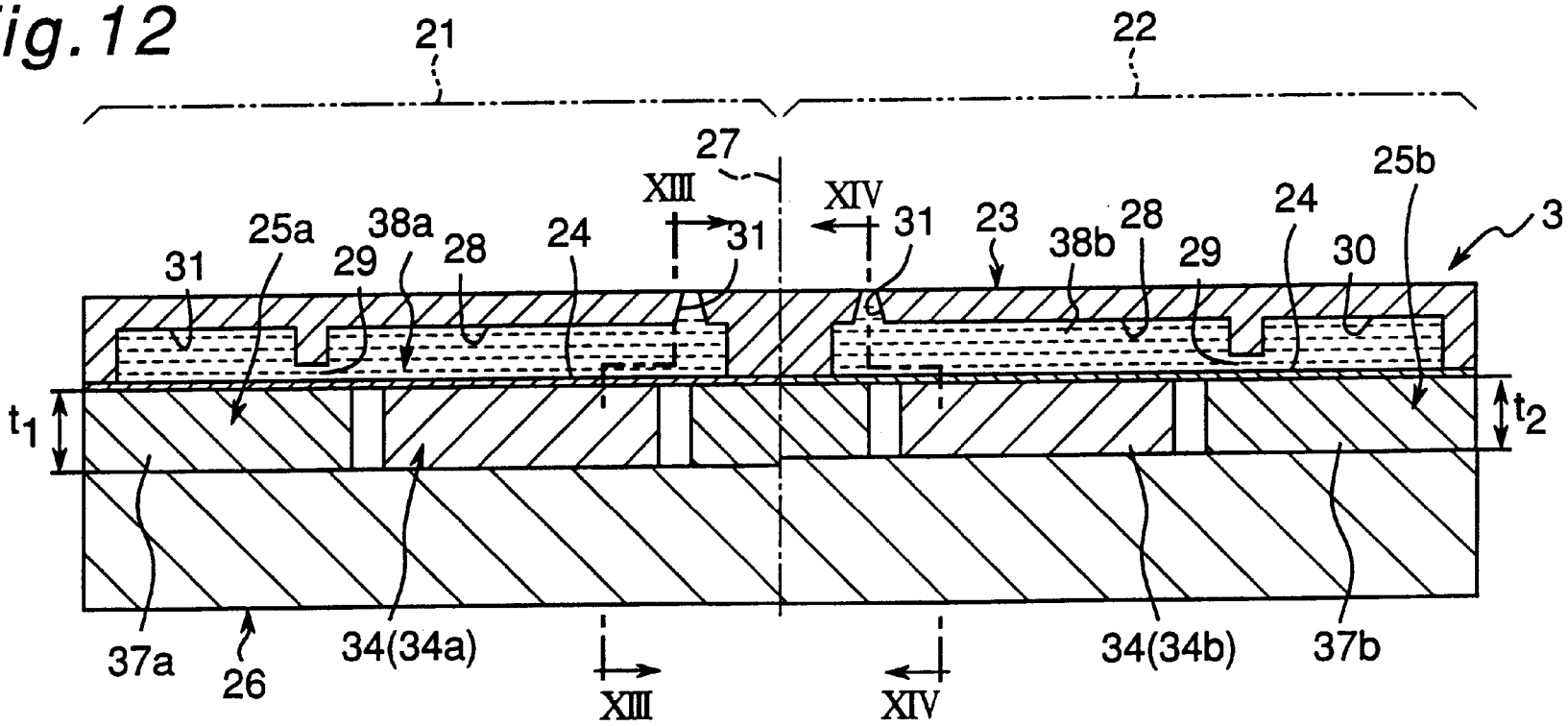
FIG. 12 is an enlarged plan view of the ink-jet head of the third embodiment.
Figure 13:
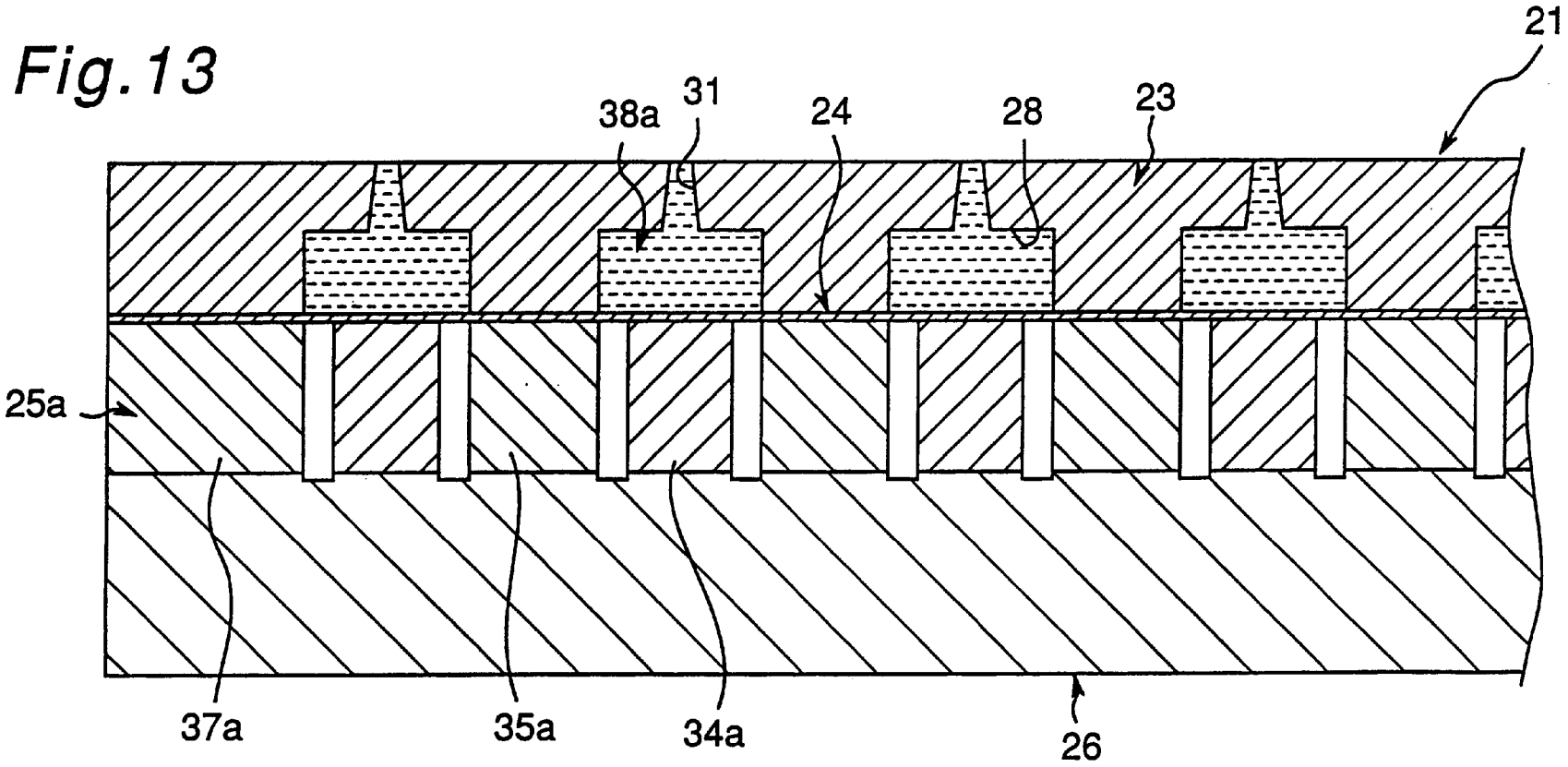
FIG. 13 is an enlarged cross sectional view of the ink-jet recording head taken along a line XIII—XIII in FIG. 12.
Figure 14:
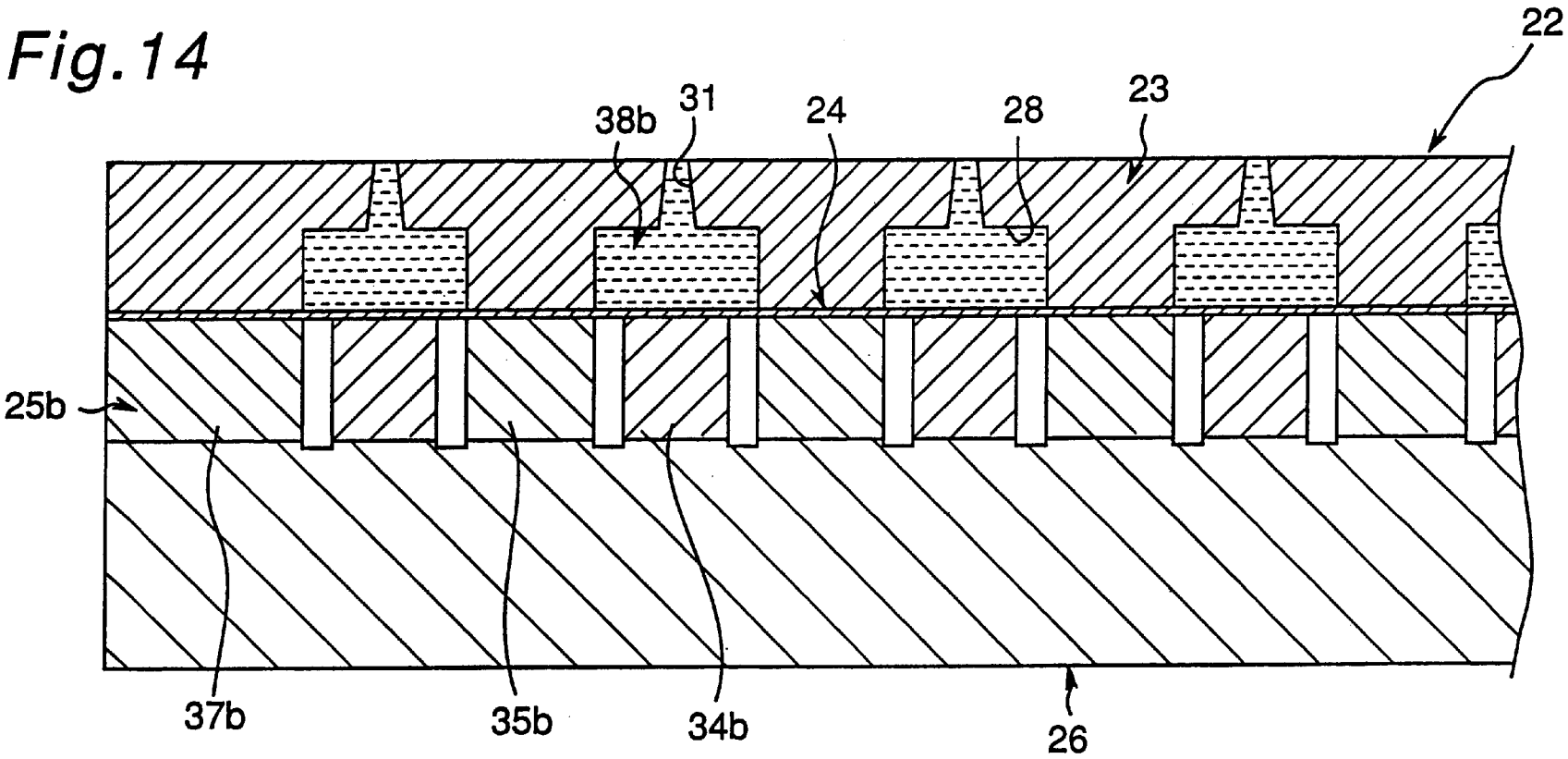
FIG. 14 is an enlarged cross sectional view of the ink-jet recording head taken along a line XIV—XIV in FIG. 12.
Figure 15:
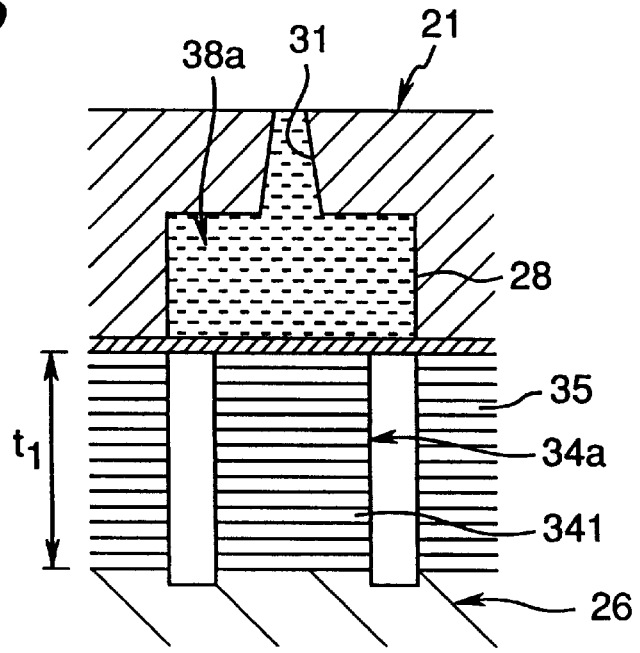
FIG. 15 is an enlarged cross sectional view of the multi-layered piezoelectric member in the first head portion of the third embodiment.
Figure 16:
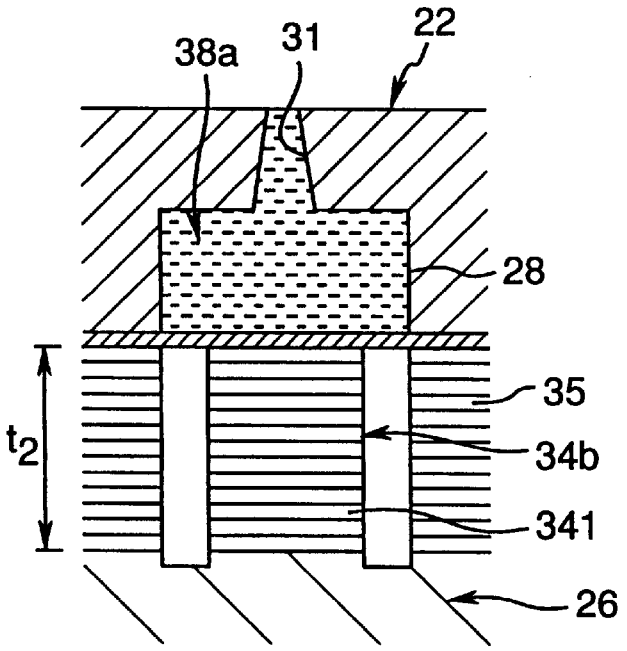
FIG. 16 is an enlarged cross sectional view of the multi-layered piezoelectric member in the second head portion of the third embodiment.

Another test was conducted in which the diameters of the nozzles in the first and second head portions were 43 micron meters and 35 micron meters, respectively. Other conditions were the same as the first test. The result is illustrated in FIG. 11 which shows that the difference of the diameters of dots formed by the first and second head portions increase in proportion to the nozzle size.

Third Embodiment

Referring to FIGS. 12 to 16, one portion 25*a* of the intermediate plate 25 in the first head portion 21 has a thickness of t1 while the other portion 25*b* thereof in the second head portion 22 has a thickness of t2. The portions 25*a* and 25*b* may be formed integrally or separately.

The plate portion 25*a* consists of a plurality of piezoelectric members 34*a* adjacent to the ink cavities 28, partitions 35*a* between the neighboring piezoelectric members 34*a*, and a rectangular frame 37*a* surrounding the piezoelectric members 34*a* and partitions 35*a*. Likewise, the plate portion 25*a* consists of a plurality of piezoelectric members 34*a* adjacent to the ink cavities 28, partitions 35*b* between the neighboring piezoelectric members 34*b*, and a rectangular frame 37*b* surrounding the piezoelectric members 34*b* and partitions 35*b*.

Figure 17:
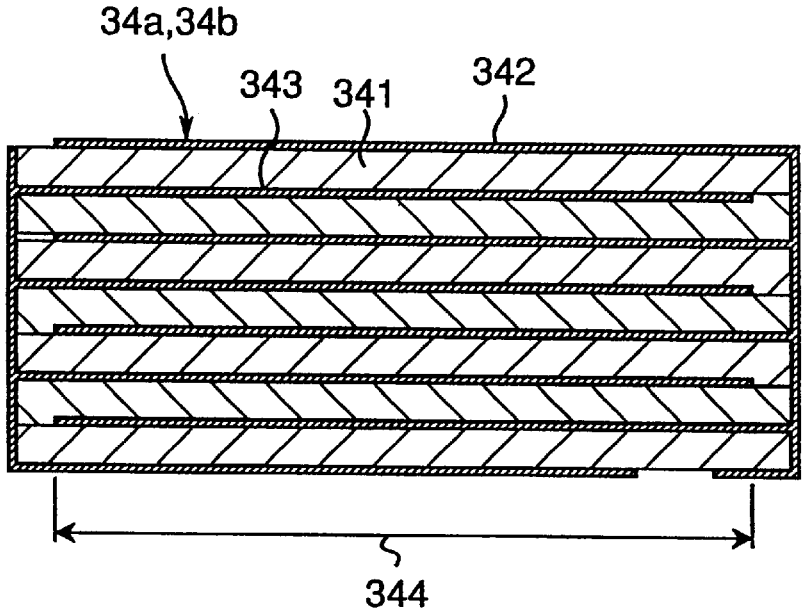
FIG. 17 is an enlarged cross sectional view of the multi-layered piezoelectric member of the third embodiment which shows a sandwiched region of the piezoelectric member.

Each of the piezoelectric members 34*a* and 34*b*, in the form of rectangular in cross section, consists of a plurality of laminated piezoelectric sheets 341 (see FIGS. 15 and 16) made of piezoelectric material such as ceramic. As shown in FIG. 17, each of the piezoelectric sheet 341 is sandwiched between the common electrode 342 and the individual electrode 343. The common electrodes 342 and individual electrodes 343 are extended from opposite longitudinal ends of the piezoelectric member to nip a specific region, i.e., sandwiched region 344, of the piezoelectric sheets 342. The sandwiched region 344 of the piezoelectric sheets 342 are polarized by the application of a high voltage between the common and individual electrodes 342 and 343.

The number of the piezoelectric sheets 342 in the portion 25*a* is greater than that in the portions 25*b* so that the thickness t1 of the portion 25*a* is greater than the thickness t2 of the portion 25*b*. Except for thickness, the portions 25*a* and 25*b* have the same length and width.

Therefore, when the voltage is applied between the common and individual electrodes 342 and 343, the portion 25*a* provides a greater deformation than the portion 25*b*. Then, the ink materials in the first head portion 21 is pressurized greater than that in the second head portion 22. As a result, when the same voltage is applied to the first and second portions 25*a* and 25*b*, the first head portion 21 ejects ink droplets which are larger than those ejected from the second head portion 22.

In view of above, by selecting first or second head portions 21 or 22 and further changing the voltage to be applied between the common and individual electrodes according to the image to be reproduced, the halftone reproductivity can be varied in a wide rage to thereby form a picture-like image with a smooth color gradation.

It is to be understood that a diameter of the nozzle 31 in the first head portion 21 may be larger than that in the second head portion 22, which ensures a wider range of halftone reproductivity.

Further, although the piezoelectric member is constructed by a plurality of layers or piezoelectric sheets, it may be a single layer piezoelectric sheet. The single layer piezoelectric member is formed to have a certain dimension and then provided with electrodes on the opposite surfaces.

It should be understood that the thickness of the multilayered piezoelectric member is preferably less than two millimeters which is the maximum thickness that the dicing saw can cut.

Test were conducted to obtain the relationship between the diameter of the dot formed by the first and second head portions and the thickness of the piezoelectric member.

Test 1

The piezoelectric members each consisting of 20 piezoelectric sheets (35 micron meters in thickness) and having a thickness of 700 micron meters were used for the first head portion 21 while the piezoelectric members each consisting of 10 piezoelectric sheets (35 micron meters in thickness) and having a thickness of 350 micron meters was used for the second head portion 22. The width of the piezoelectric members for the first and second head portions was 150 micron meters. The length of the sandwiched region 344 in the longitudinal direction was 3,000 micron meters long. A film made of aramid resin, having a thickness of 6 micron meters, commercially available from TORAY CO. was used for the diaphragm. Coated papers obtained under trade designation "Sharp coated paper ST-70A4" were used. The ink material used was obtained under the trade designation "MAT-1002" from DIC (DAINIPPON IN AND CHEMICALS, INC.). The diameters of the nozzles in the first and second head portions were 35 micron meters in diameter. A pulse signal having pulse duration of 50 micron seconds was applied to the piezoelectric members.

Figure 18:
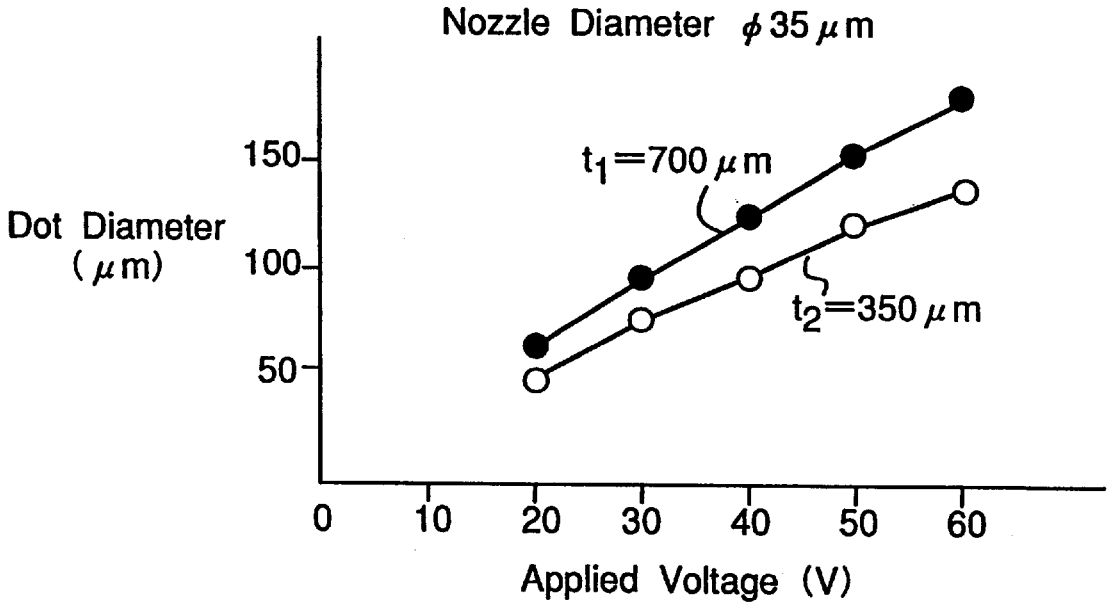
FIG. 18 is a graph showing the test result made for the ink-jet head of the third embodiment.

The result is illustrated in FIG. 18 which shows that under the same pulse voltage the ink dot formed by the first head portion with thick piezoelectric members are greater than those by the second head portion with thin piezoelectric members.

Test 2

Figure 19:
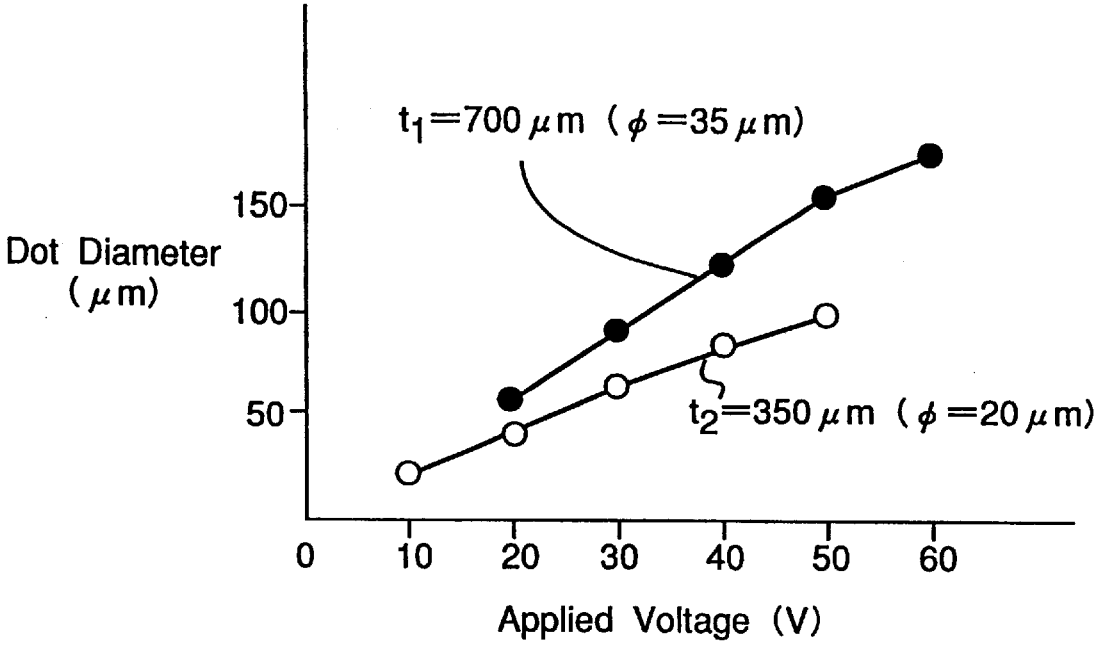
FIG. 19 is a graph showing the test result also made for the ink-jet head of the third embodiment.
Figure 20:
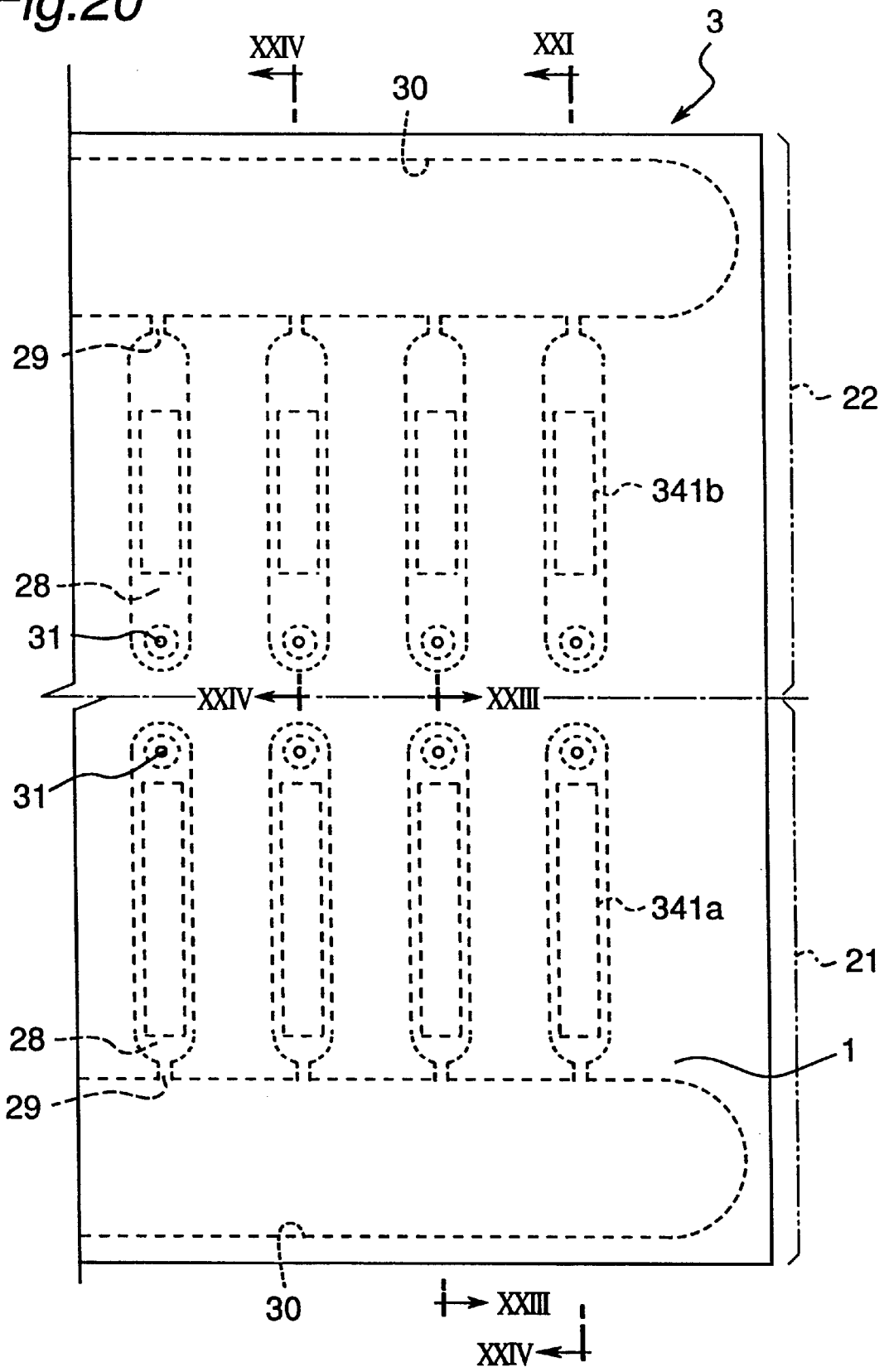
FIG. 20 is an enlarged plan view of the ink-jet head of the fourth embodiment.
Figure 21:
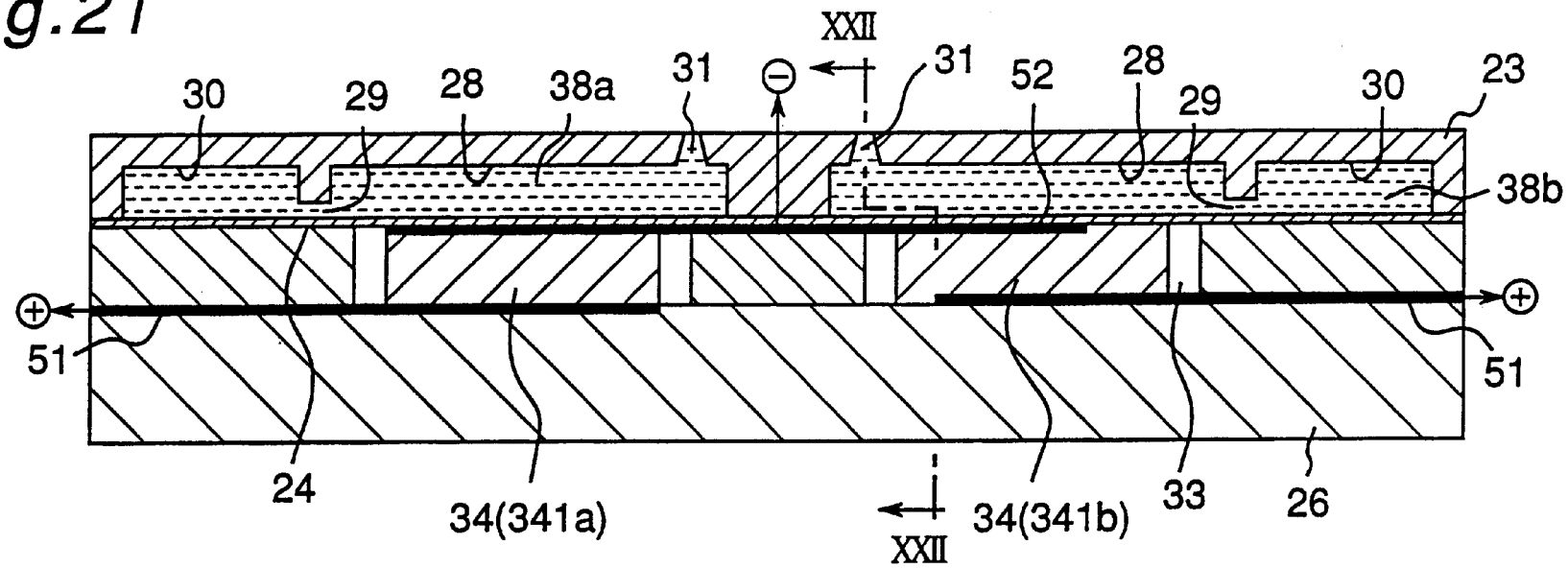
FIG. 21 is an enlarged cross sectional view of the ink-jet recording head taken along a line XXI—XXI in FIG. 20.
Figure 22:
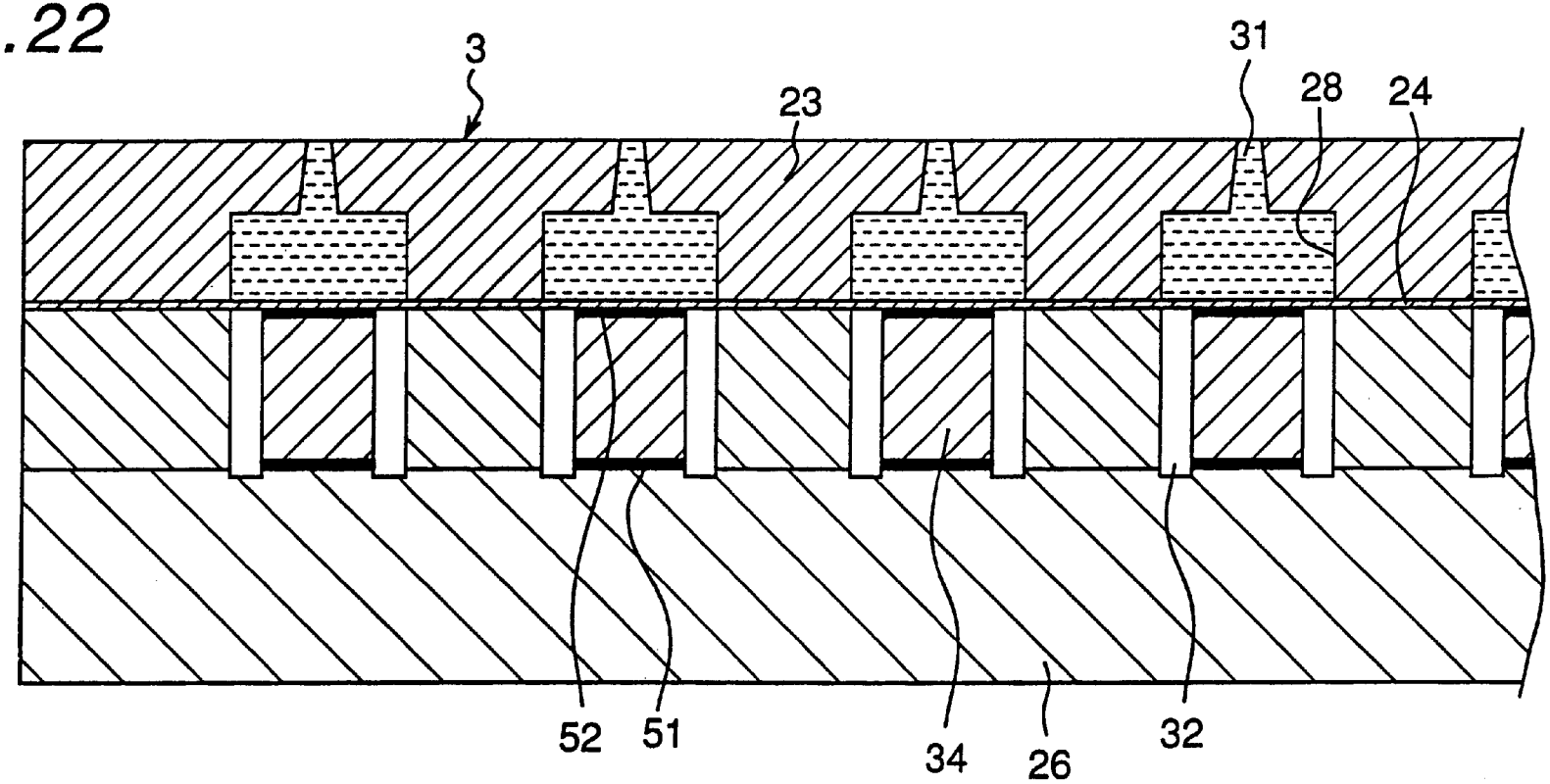
FIG. 22 is an enlarged cross sectional view of the ink-jet recording head taken along a line XXII—XXII in FIG. 20.

Another test was conducted in which the diameters of the nozzles in the first and second head portions were 35 micron meters and 20 micron meters, respectively. Other conditions were the same as the first test. The result is illustrated in FIG. 19 which shows that the difference of the diameters of dots formed by the first and second head portions are increase in proportion to the nozzle size.

Fourth Embodiment

Figure 23:
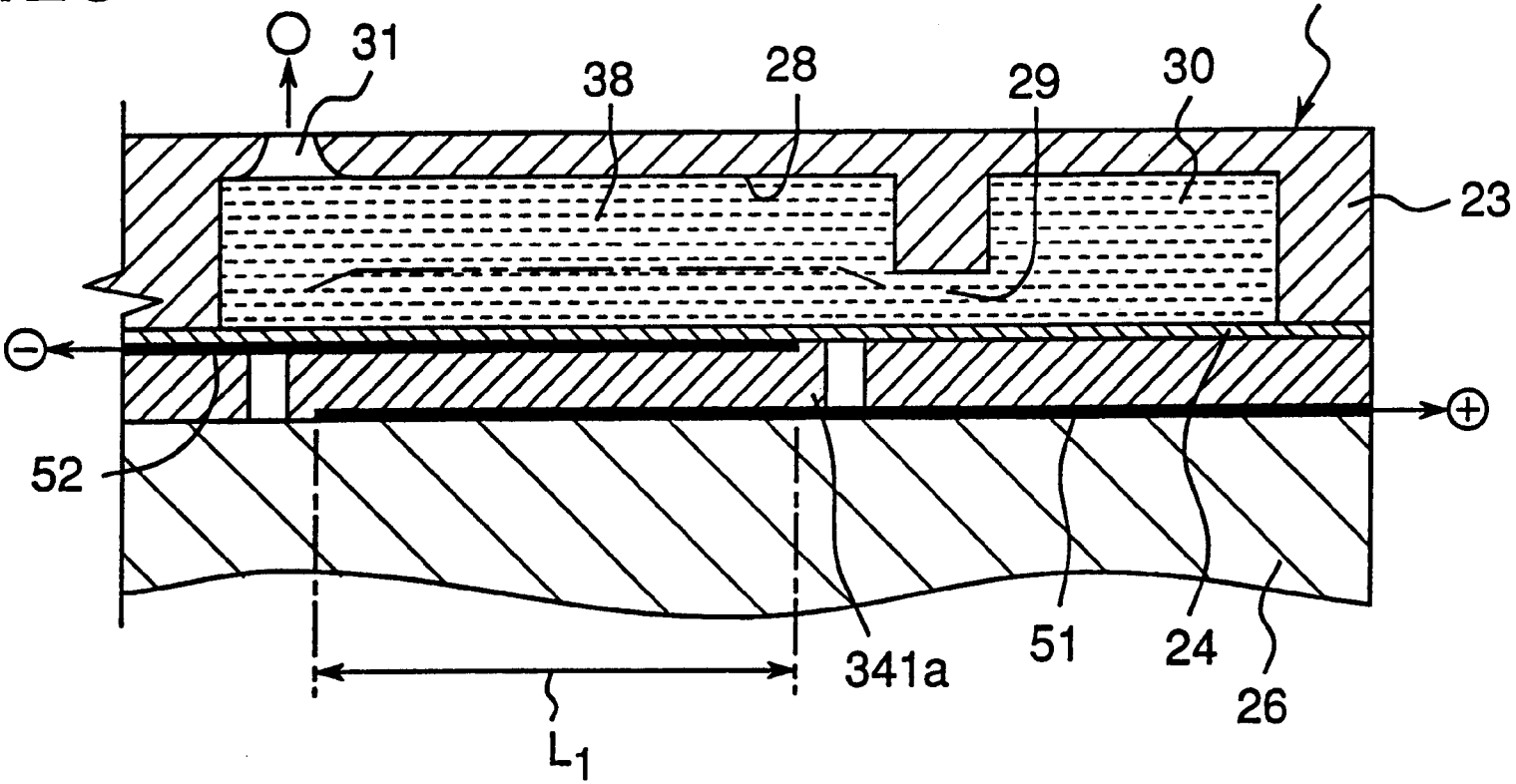
FIG. 23 is an enlarged cross sectional view of the ink-jet recording head taken along a line XXIII—XXIII in FIG. 20.
Figure 24:
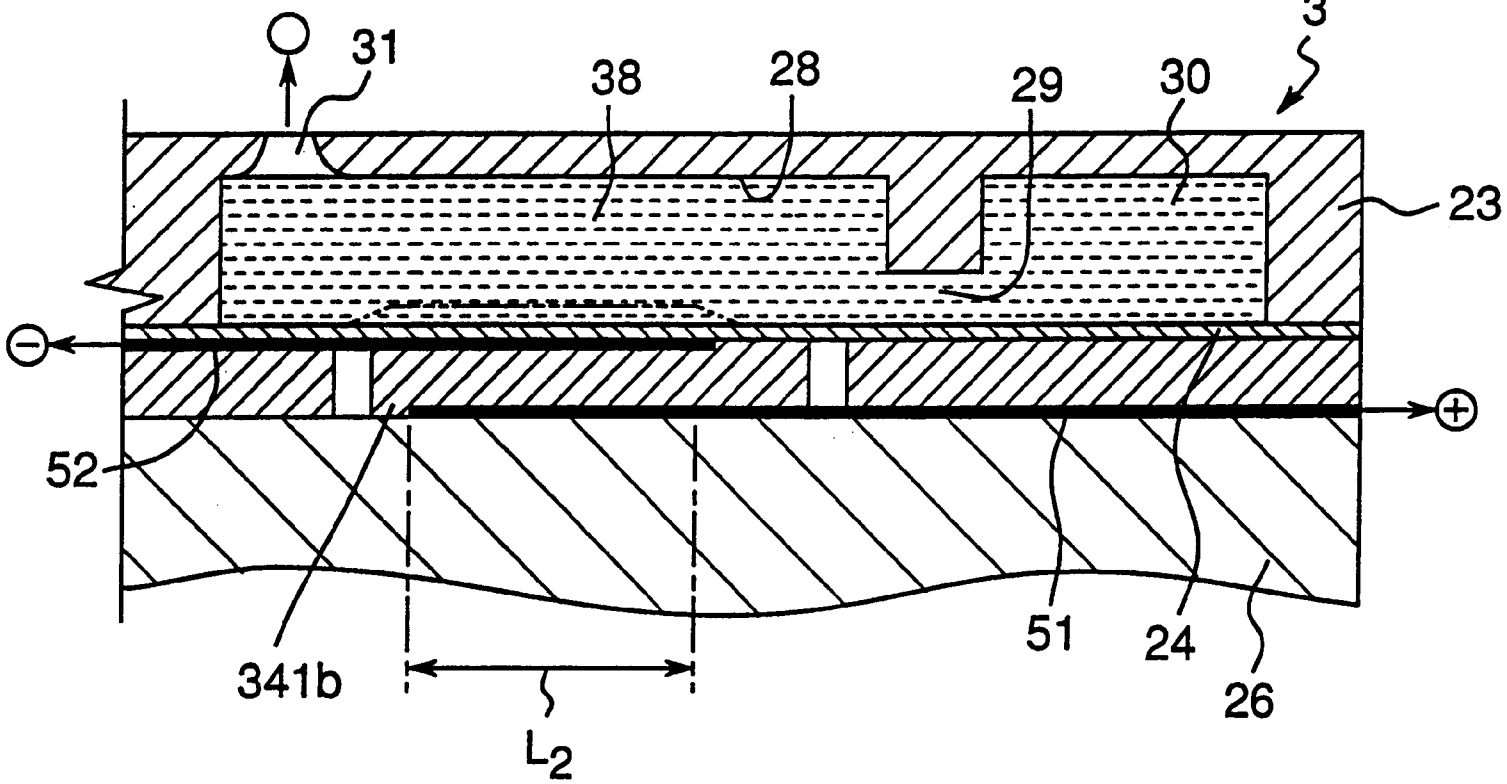
FIG. 24 is an enlarged cross sectional view of the ink-jet recording head taken along a line XXIV—XXIV in FIG. 20.

Referring to FIGS. 20 to 24, each of the piezoelectric portion 34 of the intermediate plate 25 in the first and second head portions 21 and 22 has the individual electrode 51 on one surface confronting to the base plate 26 and the common electrode 52 on the opposite surface confronting to the diaphragm 24. A region 341*a* of the piezoelectric portion 34 in the first head portion 21, sandwiched by the individual and common electrodes 51 and 52, is longer than a corresponding sandwiched region 341*b* of the piezoelectric portion 34 in the second head portion 22. The sandwiched regions 341*a* and 341*b* are polarized by the application of high voltage while they are heated so that they can deform or vibrate when they are applied with a voltage, thereby pressurizing the ink material 38 in the ink cavity 28. In FIGS. 23 and 24, the lengths of the sandwiched region 341*a* and 341*b* are designated by reference L1 and L2, respectively.

With this arrangement, when a certain voltage is applied to the individual and common electrodes 51 and 52, the deformation of the sandwiched regions 341*a* is greater than that of the sandwiched region 341*b*. As a result, the ink droplets ejected from the first head portion 21 and the resultant ink dots deposited on the recording sheet are larger than those ejected from and deposited by the second head portions.

Figure 25:
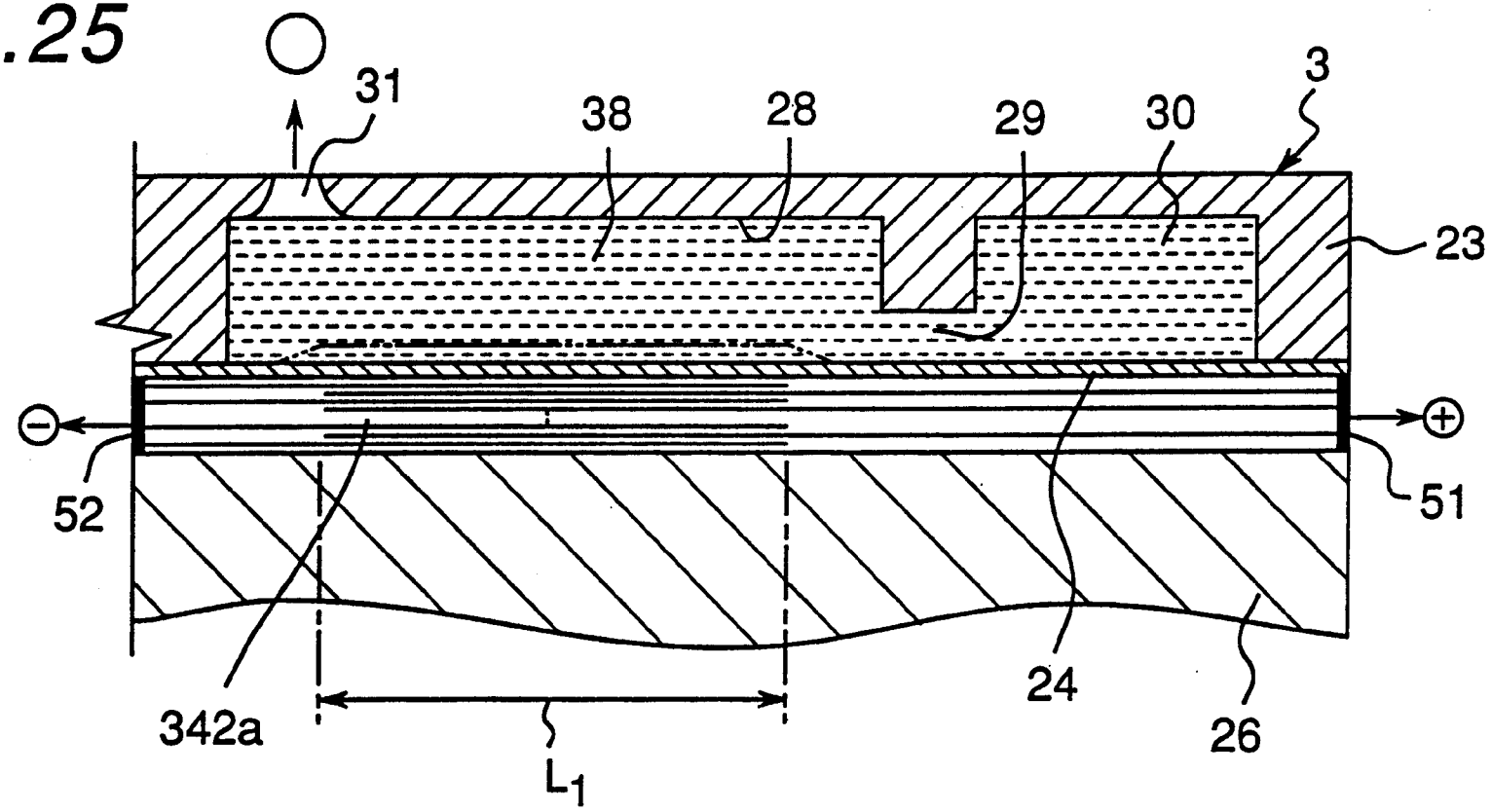
FIG. 25 is an enlarged cross sectional view of the ink-jet recording head which shows a multi-layered piezoelectric member for the fourth embodiment.
Figure 26:
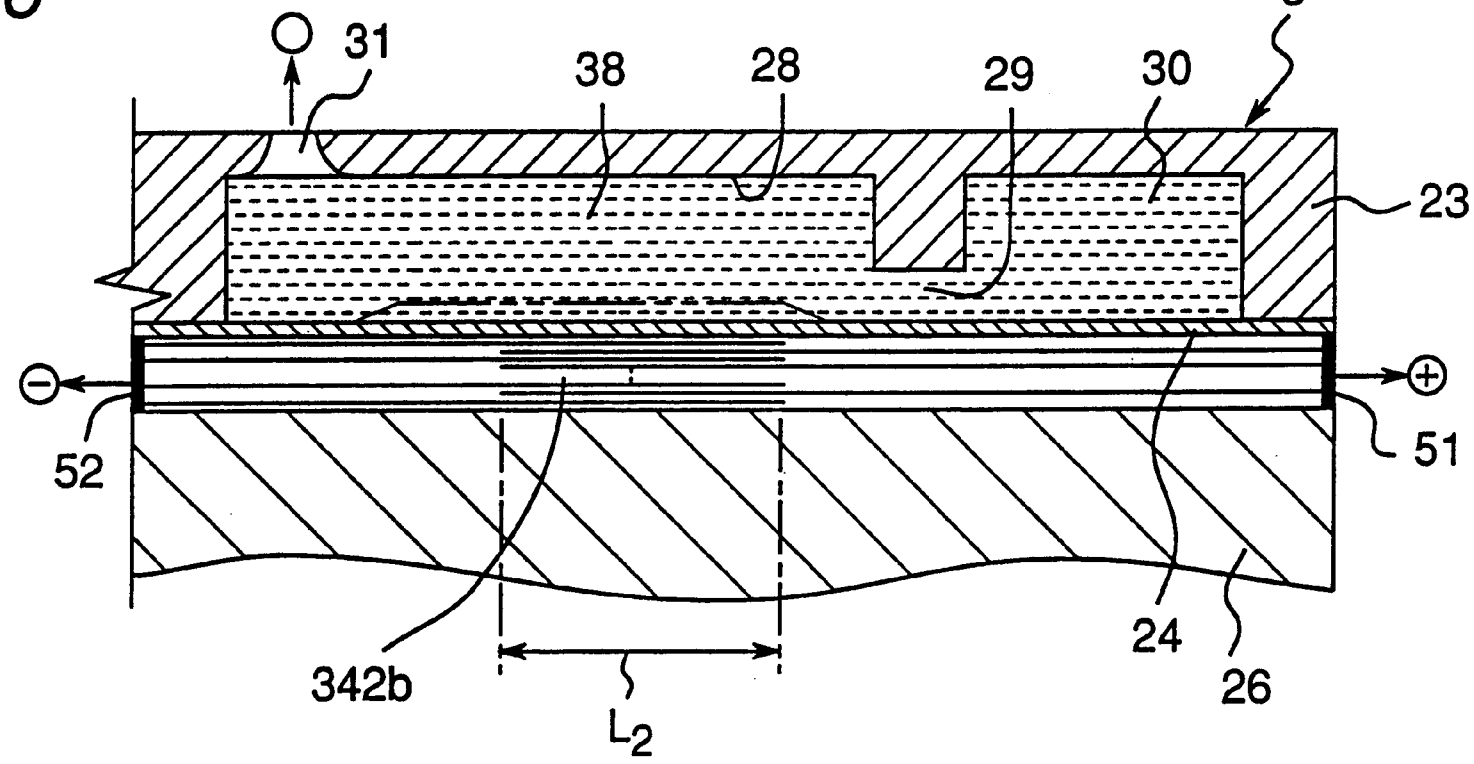
FIG. 26 is an enlarged cross sectional view of the ink-jet recording head which shows a multi-layered piezoelectric member for the fourth embodiment.

It is to be understood that the piezoelectric portions in the first and second portions may be multi-layered piezoelectric members as shown in FIGS. 25 and 26. In this multi-layered piezoelectric member, the plurality of individual and common electrodes are so interposed alternately that distal end portions thereof overlap each other. The overlapped length L1 of the individual and common electrodes in the first head portion 21 is longer than the length L2 in the second head portion 22 so that the first head portion 21 can eject the ink droplets each having larger diameter than those ejected from the second head portion 22.

According to the ink jet recording device, simply by providing different patterns of electrodes to the first and second head portions, respectively, not by altering the configuration of the nozzle, ink channel, ink inlet, or piezoelectric member of one head portion from the other, ink droplets of different size can be ejected from the first and second head portions.

It is to be understood that a diameter of the nozzle 31 in the first head portion 21 may be larger than that in the second head portion 22, which ensures a wider range of halftone reproductivity.

Tests were conducted to obtain the relationship between the length of the sandwiched region and the ink dot formed on the recording sheet.

Test 1

The nozzle diameter was 30 micron meters in diameter. The ink inlet was 3,000 micron meters long, 40 micron meters height, and 40 micron meters width. The piezoelectric member consisting of 20 piezoelectric sheets (35 micron meters in thickness) was used. A pulse signal having pulse duration of 30 micron seconds and a voltage of 30 volts was applied between the individual and common electrodes. The ink material used was obtained under the trade designation "MAT-1003" from DIC (DAINIPPON IN AND CHEMICALS, INC.). The recording sheet was obtained under the trade designation "Super Fine" from EPSON.

Figure 27:
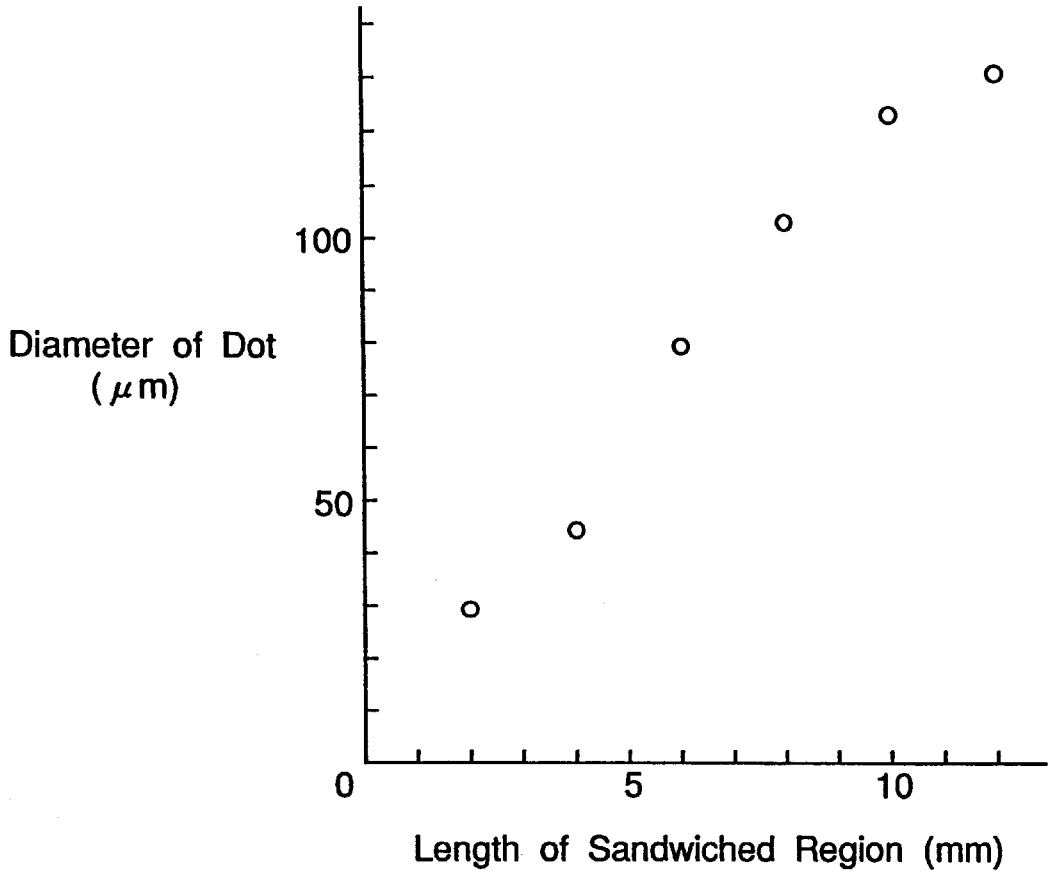
FIG. 27 is a graph showing the test result made for the ink-jet head of the fourth embodiment.

The result is illustrated in FIG. 27 which shows that the dot diameter increases in proportion to the length of the sandwiched region.

Test 2

Figure 28:
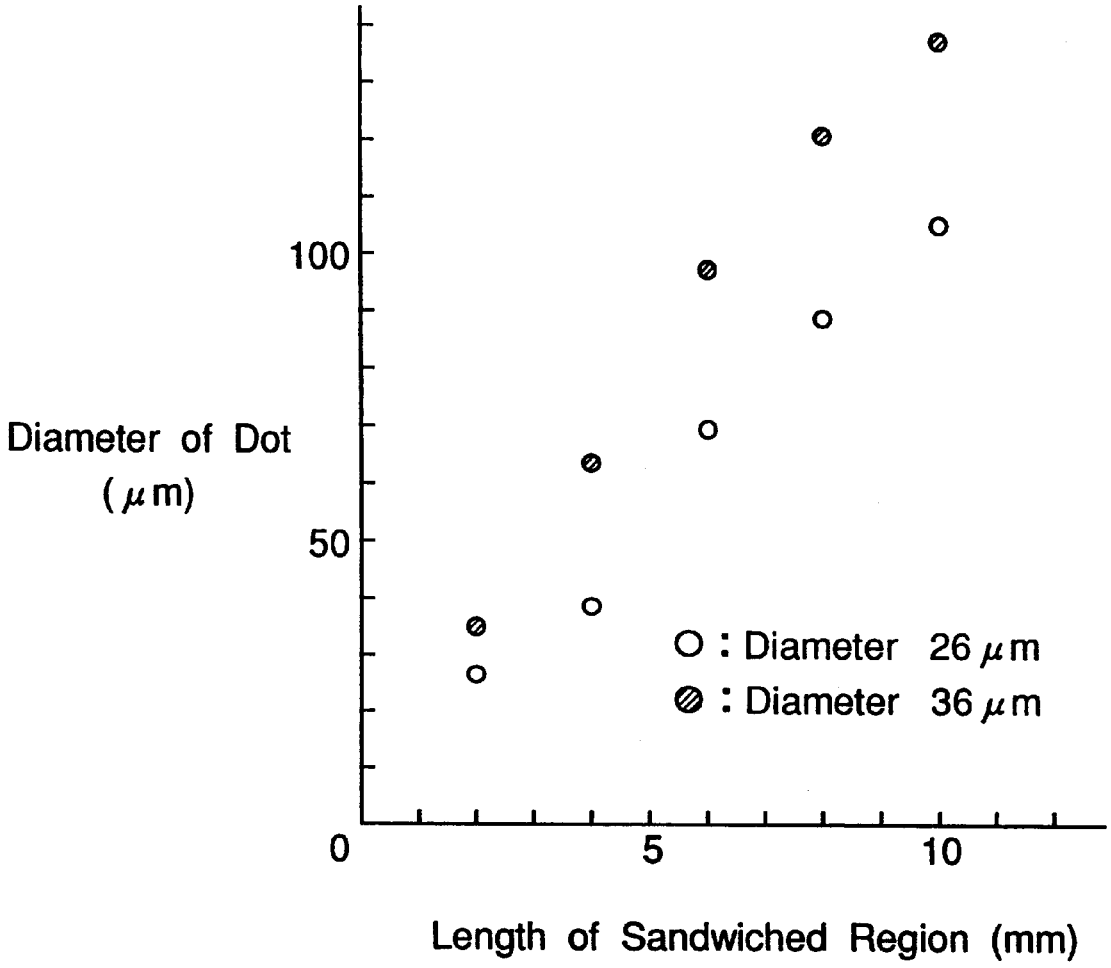
FIG. 28 is a graph showing the test result also made for the ink-jet head of the fourth embodiment.

Another test was conducted in which the diameters of the nozzles in the first and second head portions were 36 micron meters and 26 micron meters, respectively. Other conditions were the same as the first test. The result is illustrated in FIG. 28 which shows that the variation range of the diameter is changed by the change of the nozzle diameter.

Fifth Embodiment

The diameters of the ink droplets ejected from the first and second head portions 21 and 22 may be varied by providing the first and second head portions with different plarizations.

A process for manufacturing the ink-jet recording head typically includes following steps:

(1) Fixing an polarized piezoelectric plate on a substrate by the use of a bonding agent.

(2) Cutting the piezoelectric plate by a dicing saw into piezoelectric members which correspond to the ink cavities. Instead of cutting by the dicing saw, a plurality of elongated unpolarized piezoelectric member can be mounted on the substrate.

(3) Arranging the cover plate with ink cavities on the piezoelectric members.

(4) Polarizing the piezoelectric members by applying a high voltage thereto with keeping the piezoelectric members at a desired temperature by heating, if necessary. In this step, by adjusting the temperature, pressure, and application time, the polarization of the piezoelectric member can be controlled. In particular, the voltage adjustment is the most effective way for changing the polarization of the piezoelectric member.

For the first and second head portions, the piezoelectric members in the first head portion are polarized with a first condition while the piezoelectric members in the second head portions are polarized with a second condition in which the voltage applied and/or the time for applying the voltage is different that in the first condition, thereby the piezoelectric members in the first head portion is more polarized than those in the second head portions.

According to this process, as the application of voltage is performed after the completion of bonding, cutting, and assembling, the piezoelectric member will not subject to a reduction of polarization which may be caused by an elevated temperature generated at bonding of the substrate, head and other members by the use of a thermosetting adhesive that hardens over the Curie point of the piezoelectric member or at cutting of the piezoelectric plate. This ensures that each of the piezoelectric members provides a constant deformation when it is biased. This also provides the ink-jet recording head with a high precision. Further, because the polarization is performed after the completion of the steps that may provide the piezoelectric member with heat, no restriction exists in the selection of the bonding agent, which facilitates the manufacturing of the ink-jet recording head.

It is to be understood that the polarization of the piezoelectric member may be performed at any time after the dicing if the bonding of the piezoelectric members and the assembling of the head are performed using the bonding agent that can harden under the Curie point of the piezoelectric member.

Also, preferably and advantageously, the piezoelectric members are biased and then polarized using the individual and common electrodes mounted on the opposite surfaces of the members.

EXAMPLE

A piezoelectric array was obtained under the trade designation N-10, from TOKIN. Each piezoelectric member of the array was formed to have a width of 110 micron meters and spaced by 300 micron meters from each other. The piezoelectric member was polarized at its limited portion having a length of 10 millimeters.

By applying the piezoelectric members for the first head portion with 400 volts for one minute at a temperature of 20° C., the members were polarized to have a piezoelectric constant of $x=635\times10^{-12}$ (C/N). Also, by applying the piezoelectric members with 320 volts for one minute at a temperature of 20° C., the members for the second head portion were polarized to a piezoelectric constant of $X'=508\times10^{-12}$ (C/N). The piezoelectric constant represents an intensity of the polarization which can be expressed by the following equation:

$$y=V\cdot X$$

wherein y represents a displacement of the piezoelectric member, x represents the piezoelectric constant, and V represents a driving voltage.

The polarized piezoelectric members were mounted on the ink-jet recording head having nozzles of 32 micron meters in diameter. Then a certain voltage was applied to the piezoelectric members to eject the ink droplets and then the ink dot formed on the recording sheet were measured. The result is shown in the following table 1.

TABLE 1

| | DIAMETER OF DOT (μm) | | |
|---|---|---|---|
| PIEZOELECTRIC | APPLIED VOLTAGE (volts) | | |
| CONSTANT | 300 | 200 | 100 |
| $x = 635 \times 10^{-12}$(C/N) | 60 | 50 | 40 |
| $x' = 508 \times 10^{-12}$(C/N) | 54 | 46 | 36 |

Sixth Embodiment

Figure 29:
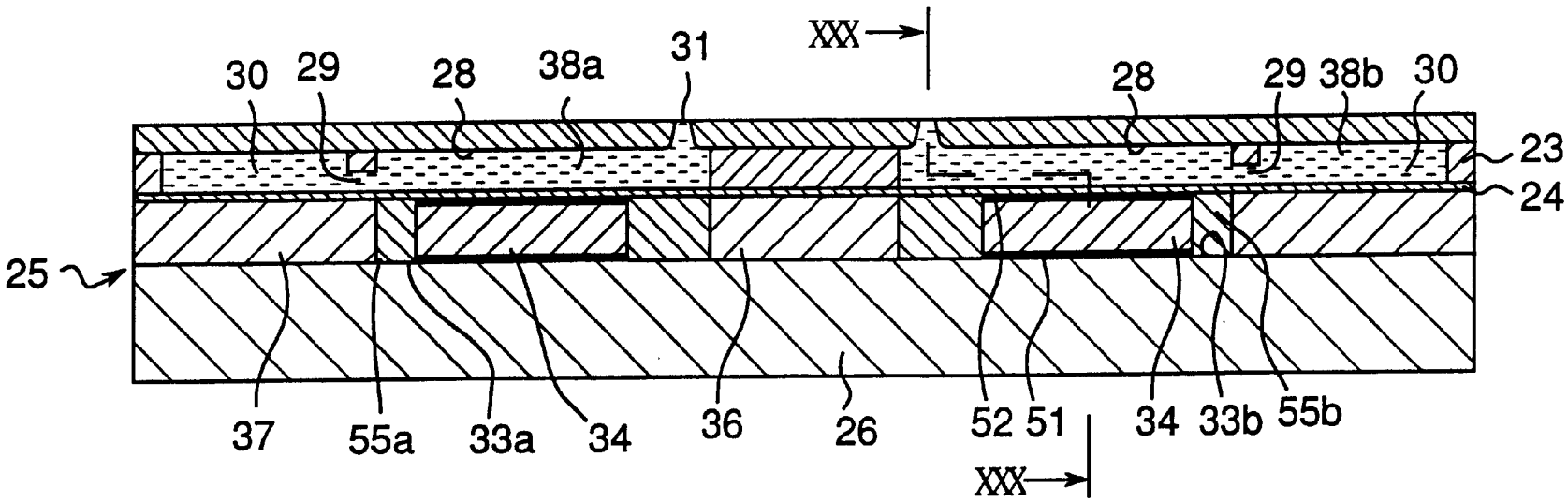
FIG. 29 is an enlarged cross sectional view of the ink-jet recording head of the sixth embodiment.
Figure 30:
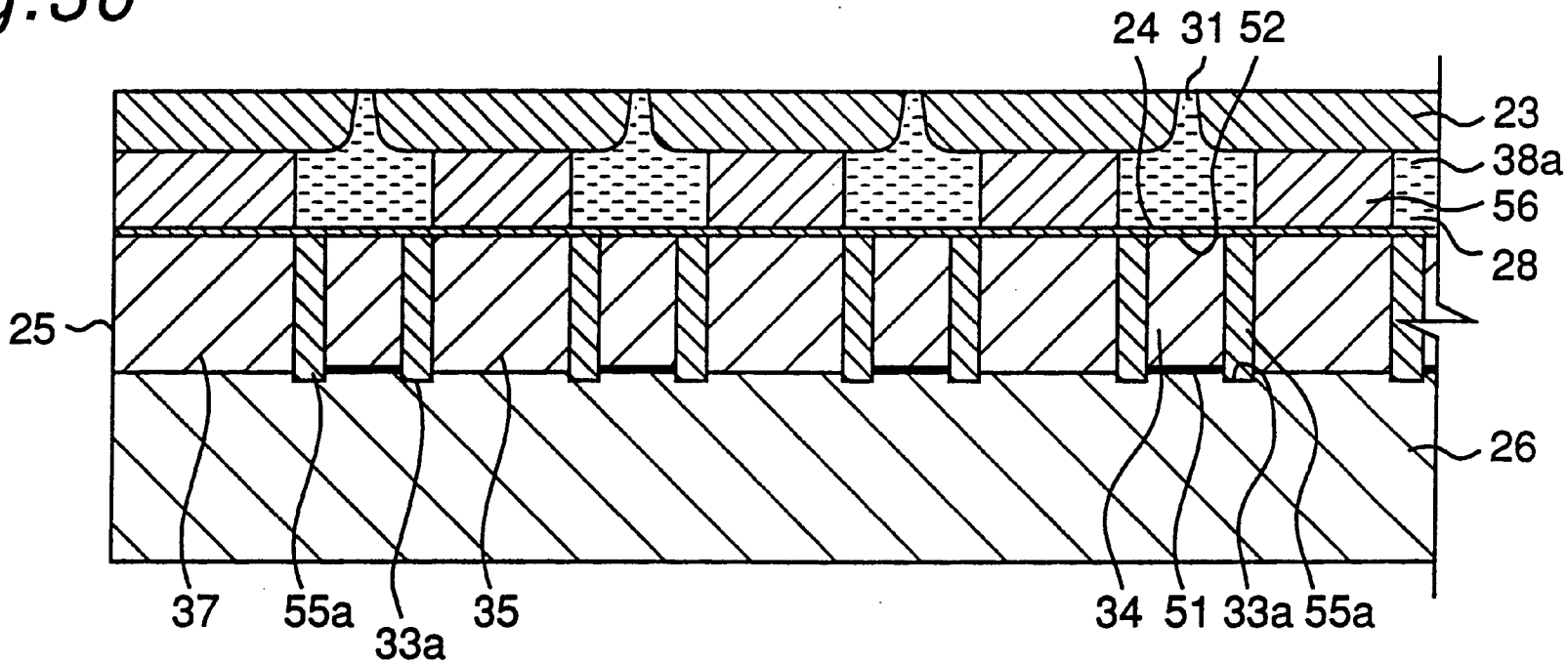
FIG. 30 is an enlarged cross sectional view of the ink-jet recording head taken along a line XXX—XXX in FIG. 29.

Referring to FIGS. 29 and 30, the grooves 33*a* surrounding the piezoelectric members 34 in the first head portion 21 are filled with a filler 55*a* and the grooves 33*b* surrounding the piezoelectric members 34 in the second head portion 22 are filled with a filler 55*b*. An elasticity of the filler 55*a* in the first head portion 21 is less than the elasticity of the filler 55*b* in the second head portion 22. The fillers 55*a* and 55*b* resist the deformations of the piezoelectric members 34 in the first and second head portions, respectively. Also, the greater the elasticity of the filler, the more resistance the piezoelectric member will subject at its deformation.

Therefore, when a certain voltage is applied between the individual and common electrodes 51 and 52, the deformation of the piezoelectric member 34 in the first head portion 21 is greater than that of the piezoelectric member in the second head portion 22. This allows the first head portion 21 to eject ink droplets having diameter which is larger than that of the ink droplets ejected from the second head portion 22.

According to the embodiment, simply by using fillers 55*a* and 55*b* each having individual elasticity not by altering the constructions or dimensions of piezoelectric member 34, the nozzle 31, ink channel 29, and ink supply chamber 30 of the first head portion 21 from those of second head portion, different size of ink droplets can be ejected from the first and second head portions, thereby the ink-jet recording device can reproduce a halftone image with large size and small size ink droplets. Also, this simplifies the manufacturing and machining of the parts of the ink-jet recording head and decreases the number of parts of the ink-jet recording head, which ensures an inexpensive manufacturing of the head.

Test 1

The filler 55*a* for the first head portion was obtained under the tradename "TAKERACK" (Two liquid Urethane based, Grade:XA-320 m, Elasticity:70 kgf/mm$^2$) from TAKEDA CHEMICALS and the filler 55*b* for the second head portion was obtained under the trade designation "UV Epoxy" (Epoxy based, Grade:T-470/UR-7047-8, Elasticity:190 kgf/mm$^2$). The diameter of the nozzle both in the first and second head portion was 35 micron meters.

Figure 31:
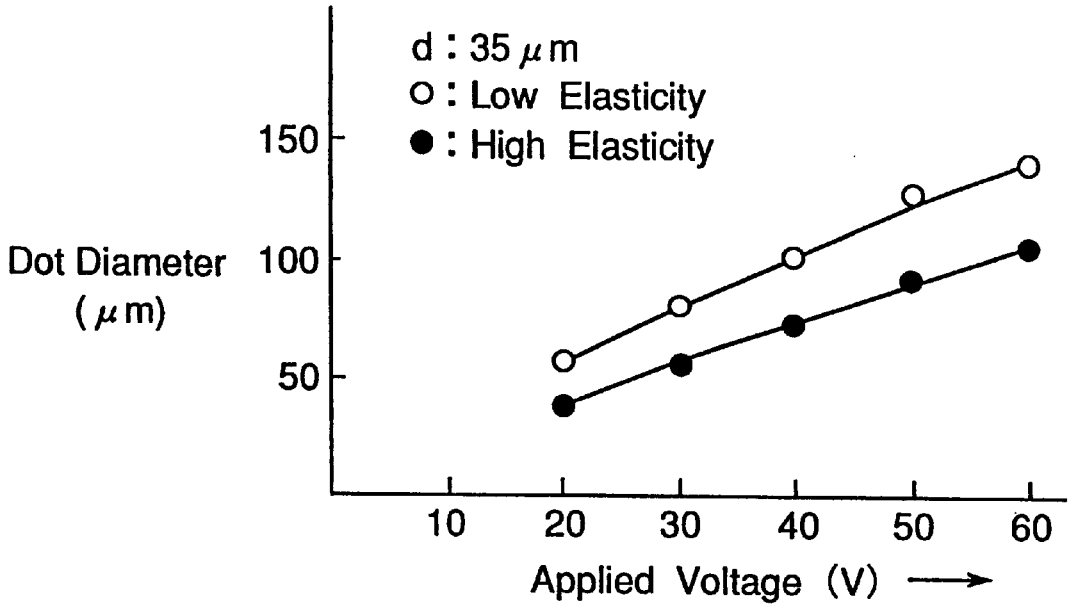
FIG. 31 is a graph showing the test result made for the ink-jet recording head of the sixth embodiment.

The result is illustrated in FIG. 31 which shows that the more elasticity increases the more the diameter of the dot decreases.

Test 2

The diameters of the nozzles in the first and second head portions were 45 micron meters and 32 micron meters, respectively. Other conditions were the same as the first tests.

Figure 32:
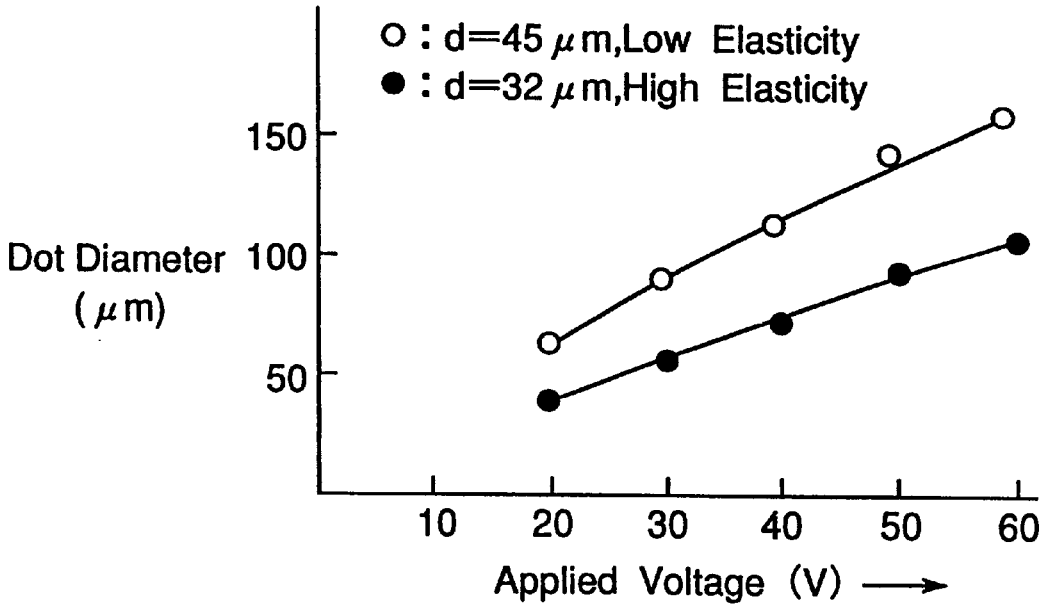
FIG. 32 is a graph showing the test result also made for the ink-jet head of the sixth embodiment.

The results are illustrated in FIG. 32 which shows that the difference of the diameters ejected from the first and second head portions is increased by changing the diameter of the nozzle. This further shows that a variety of dots having different diameters can be formed by changing both the diameter of the nozzle and the elasticity of the filler, without changing the structure of the head.

Examples of the fillers are listed in the following table 2:

TABLE 2

| | TRADENAME | MANUFACUTURER | MATERIAL | GRADE |
|---|---|---|---|---|
| A | KURAHARON RATEX | KURAHA CHEMICAL INDUSTRY CO. | VINYLIDENE CHLORIDE | DO-818 |
| | KURAHARON RATEX | KURAHA CHEMICAL INDUSTRY CO. | VINYLIDENE CHLORIDE | DO-821S |
| | TAKERACK | TAKEDA CHEMICAL CO. | TWO COMPONENT URETHANE BASED | XA-3200 |
| | ABLEBOND | ABLESTIK CO. | ONE COMPONENT EPOXY BASED | 931-1 |
| | ABLEBOND | ABLESTIK CO. | ONE COMPONENT EPOXY BASED | 941-6 |
| | ABLEBOND | ABLESTIIK CO. | ONE COMPONENT EPOXY BASED | 342-3 |
| | PLAINSET | AJINOMOTO CO. | ONE COMPONENT EPOXY BASED | AE-40 |
| | SILICONE | TORAY | TWO COMPONENT SILICONE BASED | CY52-238 |
| | VINYLIDENE CHLORIDE | TOA GOUSEI CHEMICAL INDUSTRY CO. | VINYLIDENE CHLORIDE | DX-305 |
| B | UV EPOXY | NAGASE CHIBA | EPOXY ACRYLIC RESIN BESED | XN5461 |
| | UV EPOXY | NAGASE CHIBA | EPOXY BASED | T-470/UR-7047-8 |
| C | SYMAC US | TOA GOUSEI CHEMICAL INDUSTRY CO. | SILICONE GRAFT | US-450 |
| | SYMAC US | TOA GOUSEI CHEMICAL INDUSTRY CO. | SILICONE GRAFT | US-352 |

A: Thermoset, Cold Hardening Type
B: UV Hardening Type
C: Coat Masking Agent

Seventh Embodiment

Figure 33:
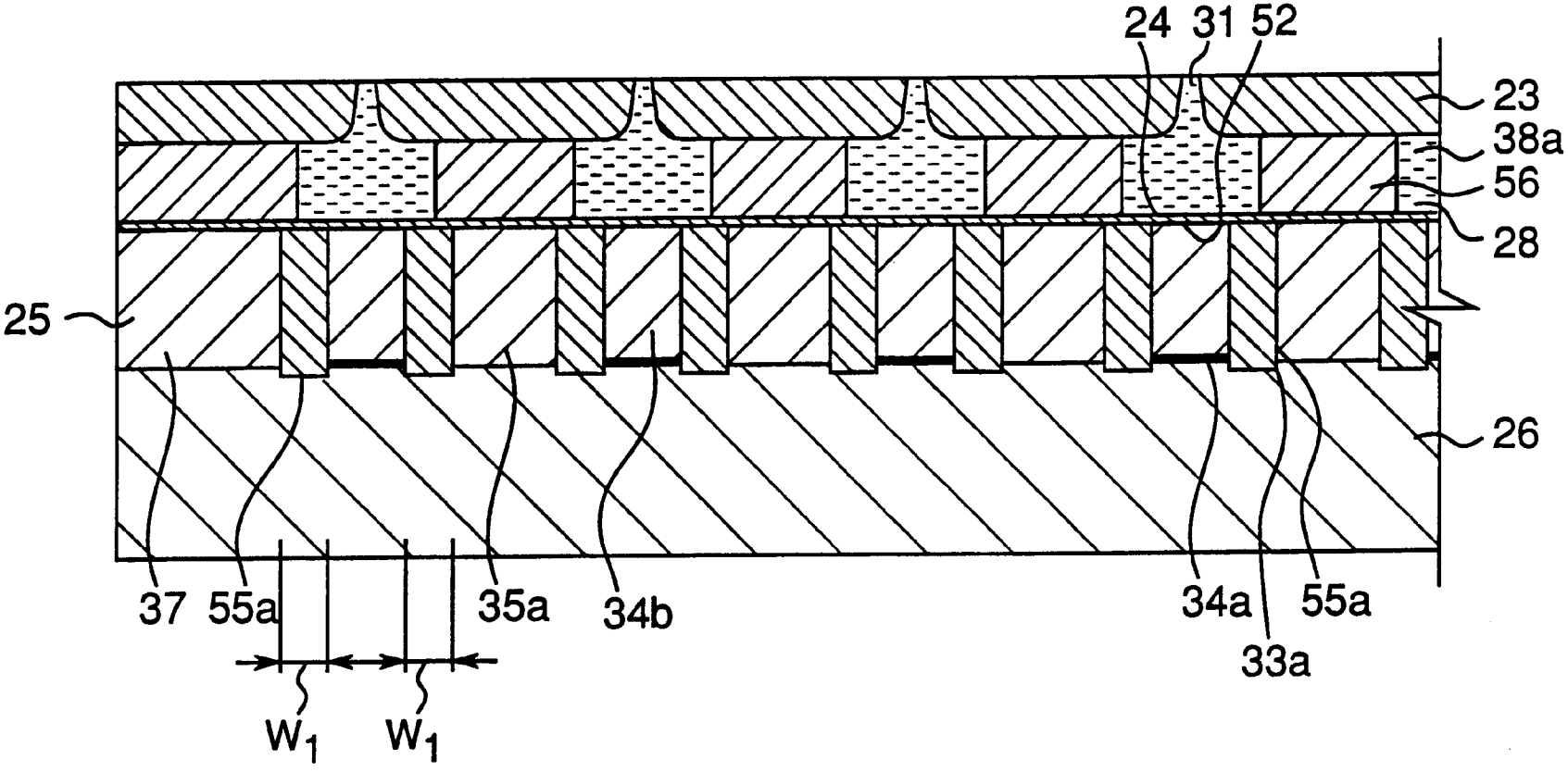
FIG. 33 is an enlarged cross sectional view of the ink-jet recording head of the seventh embodiment.
Figure 34:
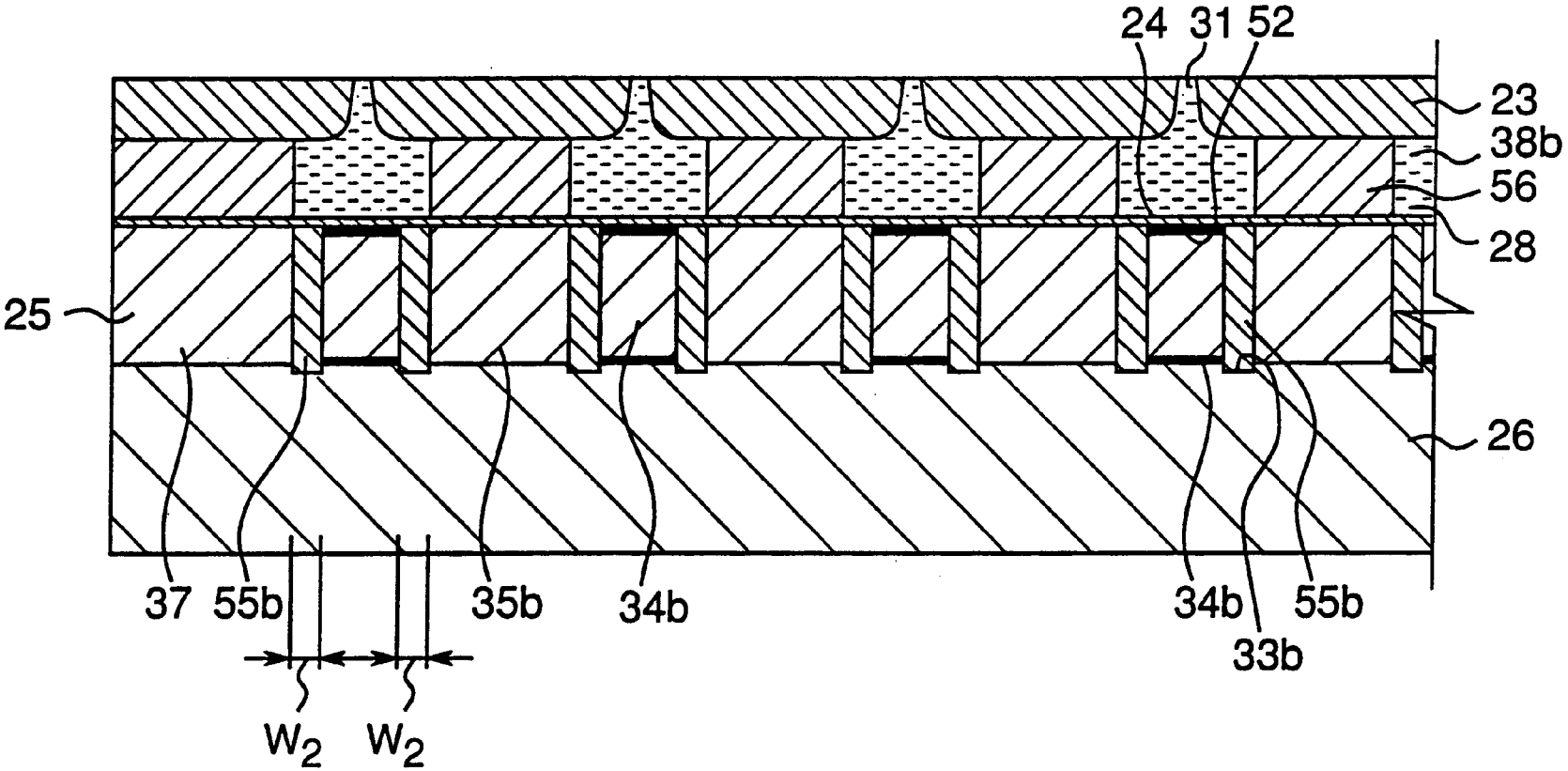
FIG. 34 is an enlarged cross sectional view of the ink-jet recording head of the seventh embodiment.

Referring to FIGS. 33 and 34, although the piezoelectric members 34*a* and 34*b* in the first and second head portions 21 and 22 are the same width, the groove 33*a* in the first head portion 21 has a width of W1 and the groove 33*b* in the second head portion 22 has a width of W2 which is smaller than the width W1. Relatively, the partition 35*a* in the first head portion 21 is narrower than the partition 35*b* in the second head portion 22. Also, the grooves 33*a* and 33*b* are filled with filler 55*a* and 55*b* having the same elasticity. The materials listed in the table 2 can be used for fillers 55*a* and 55*b*.

In this instance, the resistance that the piezoelectric member 34*a* in the first head portion 21 will receive at deformation is less than that the piezoelectric member 34*b* in the second head portion 22. Therefore, when a certain voltage is applied to the piezoelectric members 34*a* and 34*b* in the first and second head portions 21 and 22, respectively, the deformation of the piezoelectric member 34*a* is greater than that in the piezoelectric member 34*b*. As a result, the ink droplets ejected from the first head portion 21 is larger than that from the second head portion 22.

According to this embodiment, simply by forming the different size grooves in the piezoelectric plate and filling them with fillers but not by altering the constructions or dimensions of piezoelectric member 34, the nozzle 31, ink channel 29, and ink supply chamber 30 of the first head portion 21 from those of second head portion 22, different size of ink droplets can be ejected from the first and second head portions to reproduce a halftone image with large size and small size ink droplets. Also, this simplifies the manufacturing and machining of the parts of the ink-jet recording head and decreases the number of parts of the ink-jet recording head, which ensures an inexpensive manufacturing of the head.

Test 1

The grooves 33*a* of the first head portion 21 are formed to have a width of 100 micron meters while the grooves 33*b* of the second head portion 22 were formed to have a width of 50 micron meters. The diameter of the nozzle both in the first and second head portion was 35 micron meters. The filler was obtained under the tradename "Aronix" (Grade:UV-3630, Elaticity:150 kgf/mm$^2$).

Figure 35:
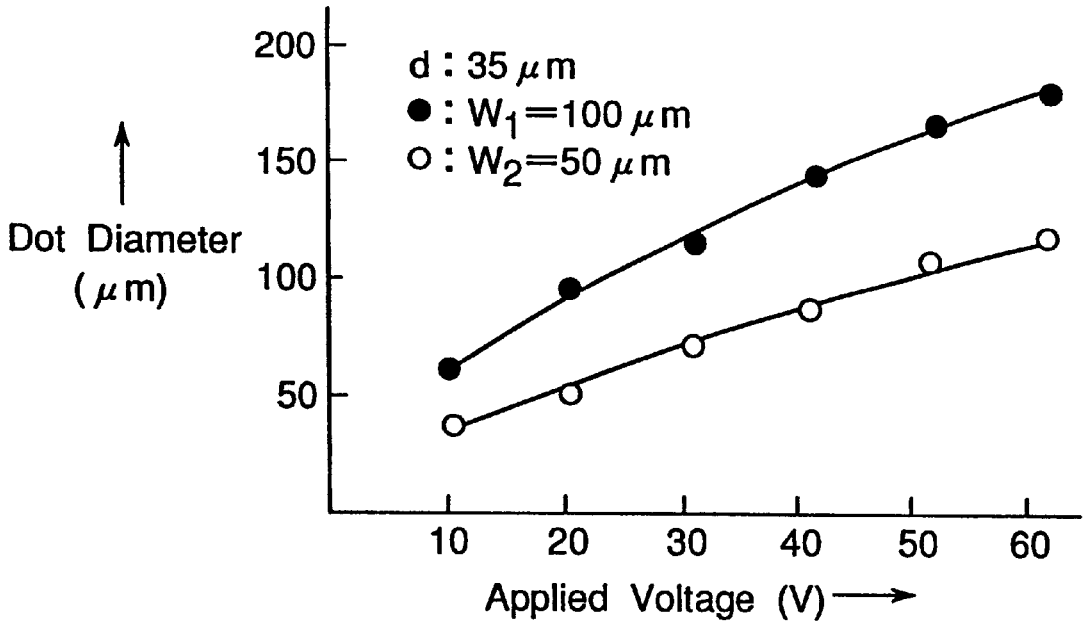
FIG. 35 is a graph showing the test result made for the ink-jet head of the seventh embodiment.

The results are illustrated in FIG. 35 which shows that the dot diameter increases with the increase of the width of the groove.

Test 2

The diameters of the nozzles in the first and second head portions were 50 micron meters and 35 micron meters, respectively. Other conditions were the same as the first tests.

Figure 36:
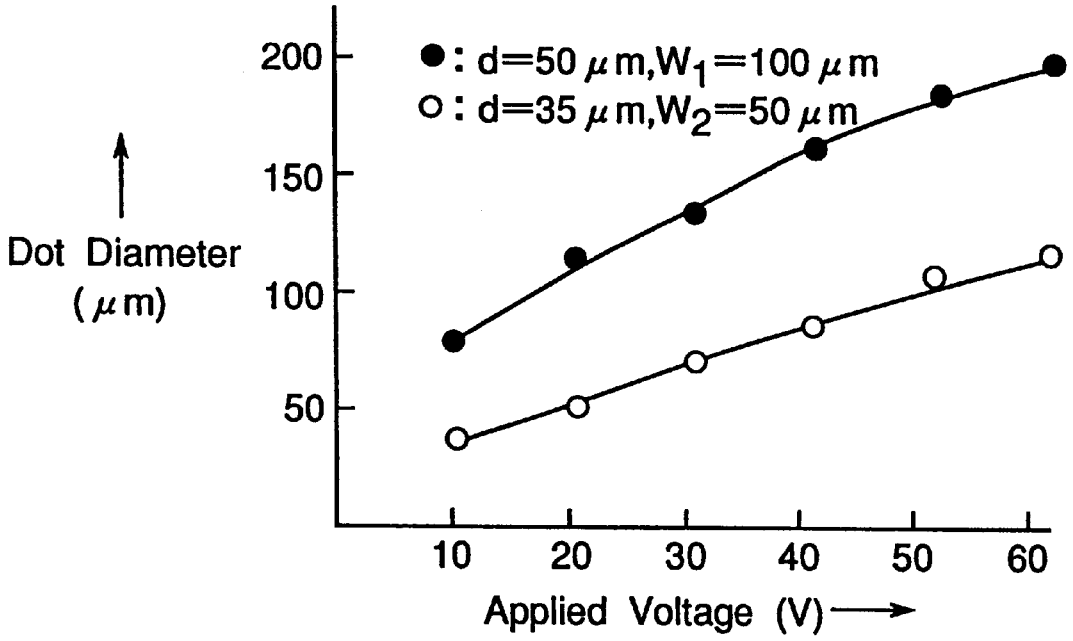
FIG. 36 is a graph showing the test result also made for the ink-jet head of the seventh embodiment.

The results are illustrated in FIG. 36 which shows that the difference of the diameters ejected from the first and second head portions is increased by changing the diameter of the nozzle. This further shows that a wide variety sizes of dots can be formed by changing both the diameter of the nozzle and the elasticity of the filler.

Eighth Embodiment

Figure 37:
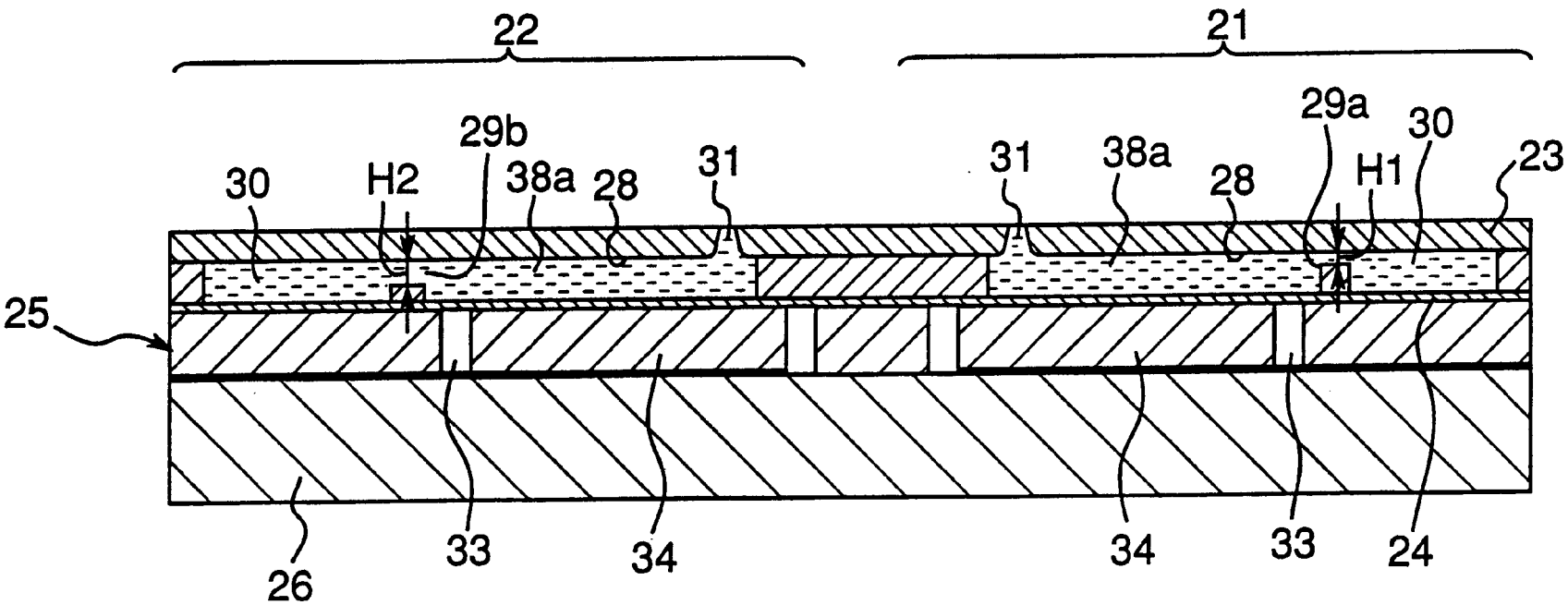
FIG. 37 is an enlarged cross sectional view of the ink-jet recording head of the eighth embodiment in which the heights of the ink inlets in the first and second head portions are different.

FIG. 37 shows an eight embodiment in which a height H1 of the ink inlet 29*a* in the first head portion 29*a* is larger than a height H2 of the ink inlet 29*b* in the second head portion 29*b* but length and width of the ink inlets 29*a* are the same as those of the ink inlets 29*b* so that a volume of the ink inlet 29*a* in the first head portion 21 is less than that of the ink inlet 29*b* in the second head portion 22. For example, the heights H1 and H2 for the ink inlets 29*a* and 29*b* may be 25 and 35 micron meters.

With this arrangement, a resistance to be received by the ink material 38*a* which moves through the ink inlets 29*a* in the first head potion 21 is designed to be less than that to be received by the ink material 38*b* which moves through the ink inlets 29*b* in the second head portion 22.

As a result, when a certain voltage is applied to the individual and common electrodes, the first head portion 21 can eject larger ink droplets than those ejected from the second head portion 22 even when the same ink materials are contained in the first and second head portions 21 and 22. It is considered that this is caused by the difference in fluid resistance of the ink cavities 29*a* and 29*b* in the first and second head portions 21 and 22, respectively, when the piezoelectric members has deformed. Specifically, as the resistance in the ink inlet 29*a* of the first head portion 21 is greater than that in the ink inlet 29*b* of the second head portion 22, less ink material is forced from ink cavity 28 back to the ink supply chamber 30 in the first head portion 21 than in the second head portion 22, which in turn renders the ink droplet from the first head portion 21 larger than that from the second head portion 22.

Therefore, by ejecting ink droplets having different sizes from first and second head portions 21 and 22, a halftone image can be printed.

Figure 38:
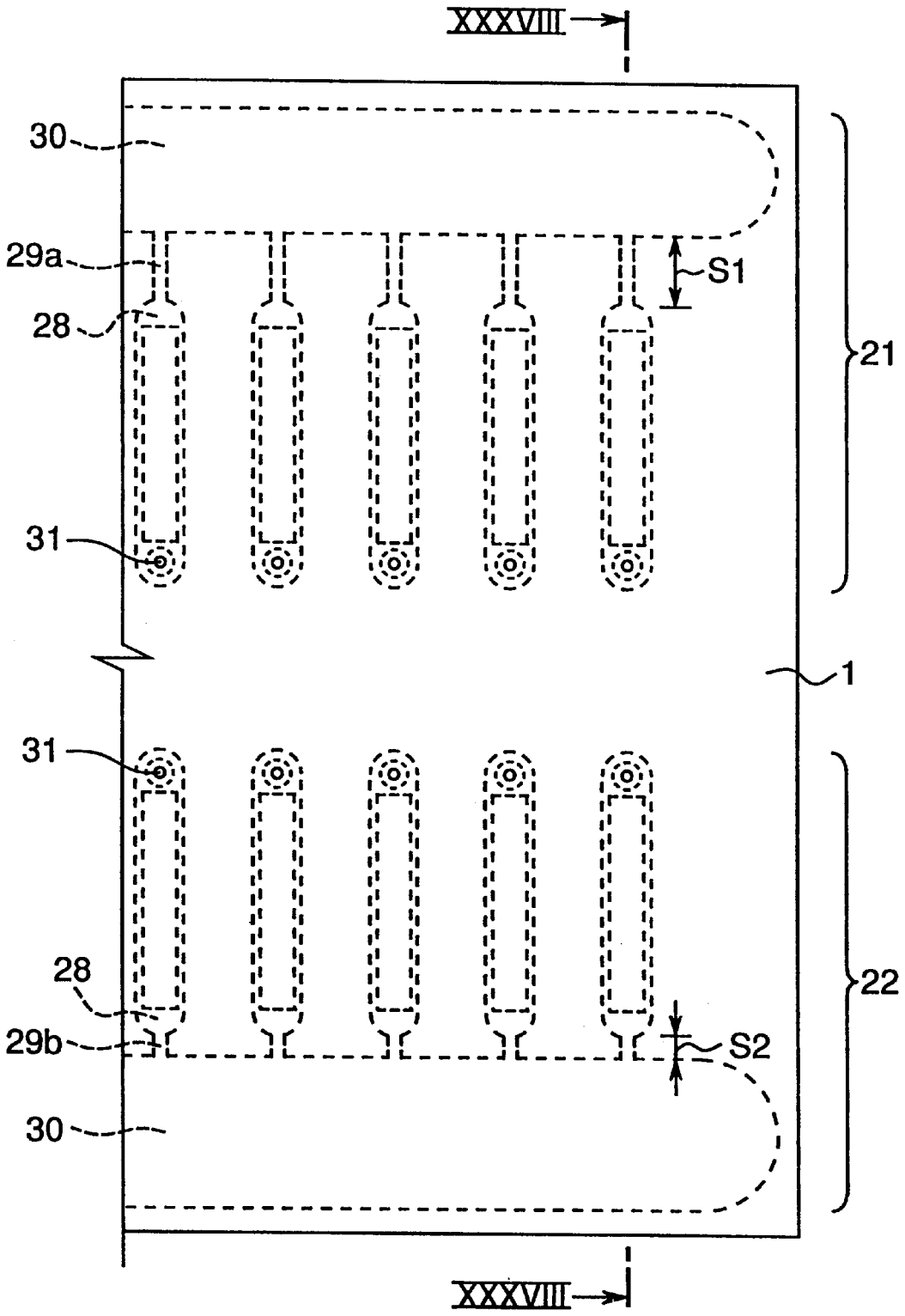
FIG. 38 is an enlarged plan view of the ink-jet recording head of the eighth embodiment in which the lengths of the ink inlets in the first and second head portions are different.

The same effect can be achieved by rendering the length of the ink inlet 29*a* of the first head portion 21 different from that of the ink inlet 29*b* of the second head portion 22. For example, in a modification shown in FIGS. 38 and 39, the length of the ink inlet 29*a* of the first head portion 21 is designed to be longer than that of the ink inlet 29*b* of the second head portion 22 with keeping the widths and depths of the ink inlets 29*a* and 29*b* the same, respectively, thereby rendering the fluid resistance in the ink inlet 29*a* of the first head portion 21 greater than that in the ink inlet 29*b* of the second head portion 22. For example, in one embodiment, the length of the ink inlets 29*a* and 29*b* are designed as 500 micron meters and 100 micron meters, respectively.

Figure 39:
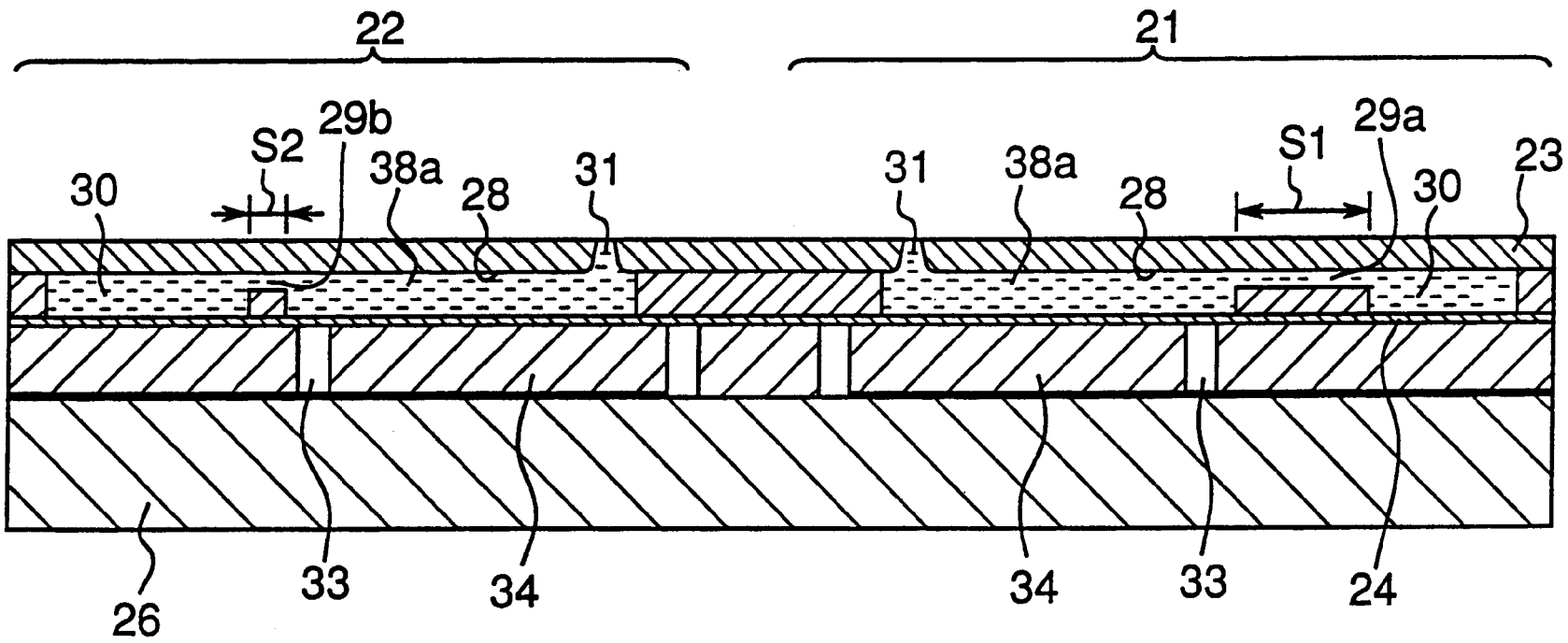
FIG. 39 is an enlarged cross sectional view of the ink-jet recording head of the eighth embodiment in which the lengths of the ink inlets in the first and second head portions are different.
Figure 40:
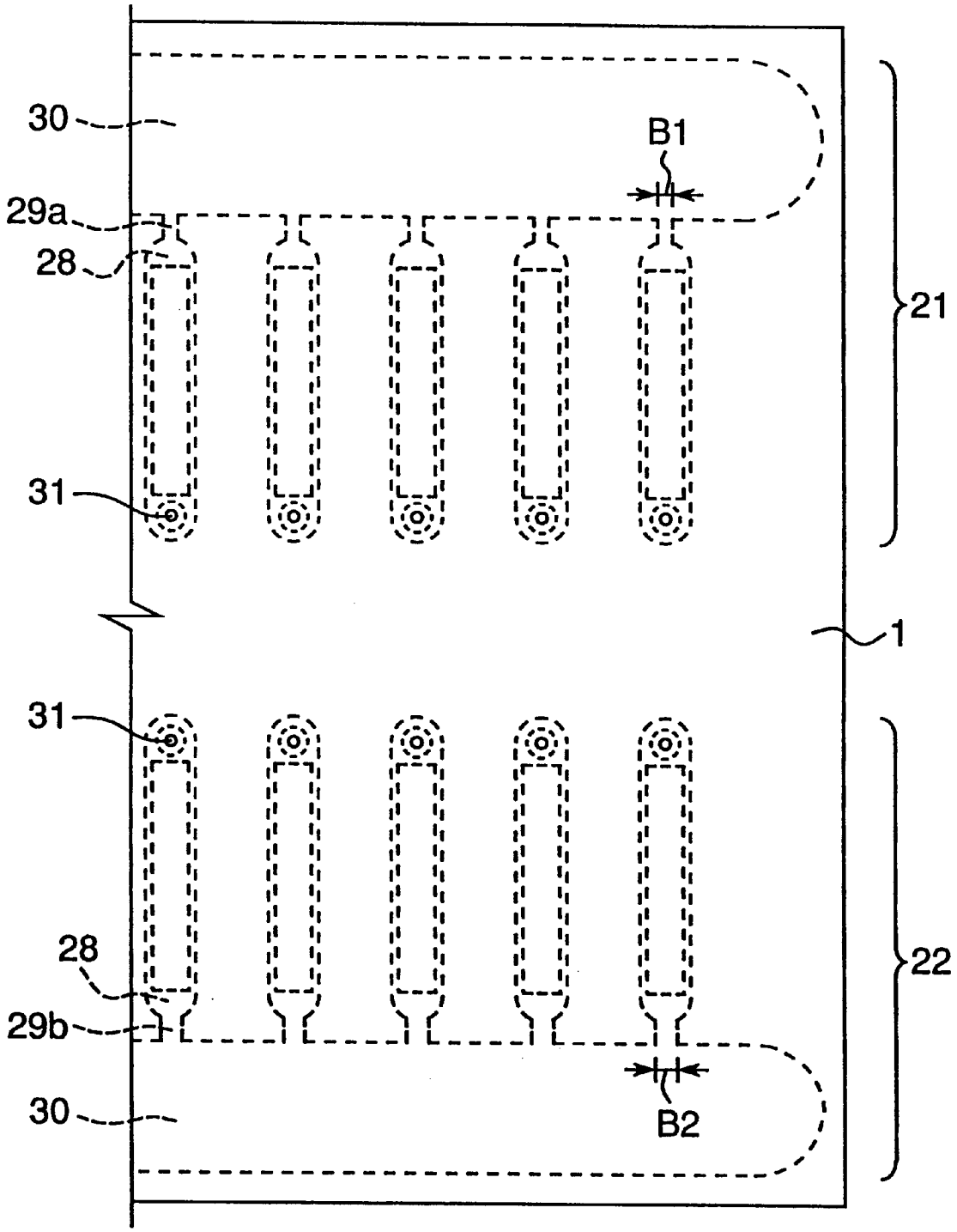
FIG. 40 is an enlarged plan view of the ink-jet recording head of the eighth embodiment in which the widths of the ink inlets in the first and second head portions are different.

Instead, as shown in FIG. 40, the width B1 of the ink inlet 29*a* may be differed from the width B2 of the ink inlet 29*b* as shown in FIG. 39 with keeping the lengths and heights thereof the same, respectively. This also ensures that the ink droplet ejected from the first head portion 21 is larger than that from the second head portion 22 due to the difference in fluid resistance of the ink inlets 29*a* and 29*b*.

Although, in the previous embodiments, only one of three factors, i.e., height, length and width, in one head portion is selectively differed from that in the other head portion and thereby providing different volumes for ink inlets of the first and second head portions, they may be differed in combination.

Also, different configurations may be provided to the ink inlets of the first and second head portions to differ the fluid resistance of the ink inlet in one head portion from that in the other head portion.

Further, the nozzle size of one head portion may be differed from that of the other head portion, which increases the tone gradation of the halftone image.

Figure 41:
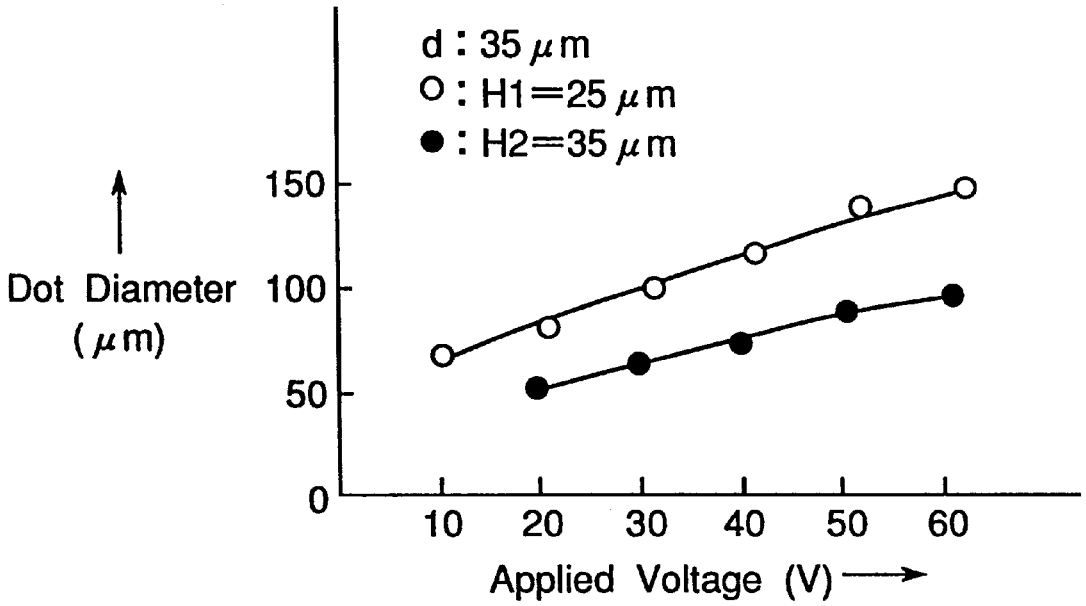
FIG. 41 is a graph showing the test result made for the ink-jet head of the eighth embodiment.

FIG. 41 shows a result of tests in which the ink inlets 29*a* and 29*b* were formed to have respective heights of 25 micron meters and 35 micron meters while the nozzles of the first and second head portions were formed to have the same diameter of 35 micron meters. Other factors, i.e., length and width of the ink inlet, of the first and second head portions were the same, respectively. The result shows that the size of the ink droplet from the first head portion was larger than that from the second head portion at respective applied voltages.

Figure 42:
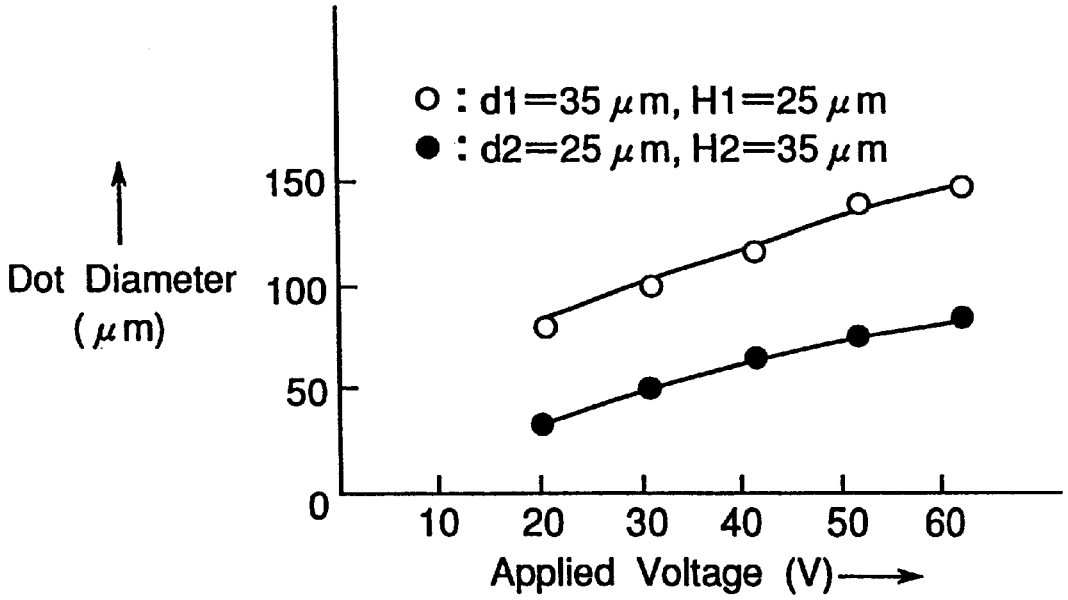
FIG. 42 is a graph showing the test result also made for the ink-jet head of the eighth embodiment.

FIG. 42 shows a result of another tests in which the nozzles 31 of the first and second head portions were formed to have respective diameters of 35 micron meters and 25 micron meters. Other conditions were the same as the previous tests. The result shows that the difference in diameters of the ink droplets is increased due to the difference in diameter of the nozzles.

Modifications and Improvements

The ink jet recording device may be improved and modified in various manners. For example, although the partitions arranged between the partitions are cut out from the piezoelectric plate in the previous embodiments, they may be formed by different materials or may be made in the base plate.

Also, although the diaphragm is made of non-conductive material, it may be made of conductive material, allowing the diaphragm to be used as common electrode.

Further, although the diaphragm is provided to keep the piezoelectric members out of contact with the ink material, the diaphragm may be eliminated therefrom. However the piezoelectric member may lose its ability of deformation if the ink material is penetrated therein. Therefore, in this case, it is preferable that the surfaces of the piezoelectric members which may contact with the ink material are covered with a coating to prevent the piezoelectric members from being in contact with the ink material.

Furthermore, although the individual and common electrodes are provided in parallel to the diaphragm in the above embodiment, they may be arranged on the surfaces perpendicular to the diaphragm.

Moreover, although the description has been made to the ink-jet recording head having two head portions, the invention can equally be applied to ink-jet recording head having three or more head portions. In this instance, each of the head portions may be provided with the diaphragm having individual elasticity and/or thickness to increase the tone gradation of the printed image, which providing the ink-jet recording device with an increased reproductivity of the halftone image.

In addition, it should be noted that the color of the ink in the first head portion may be differed from that of the second head portion, which enabling the ink-jet recording head to reproduce a colorful tone image.

Figure 43:
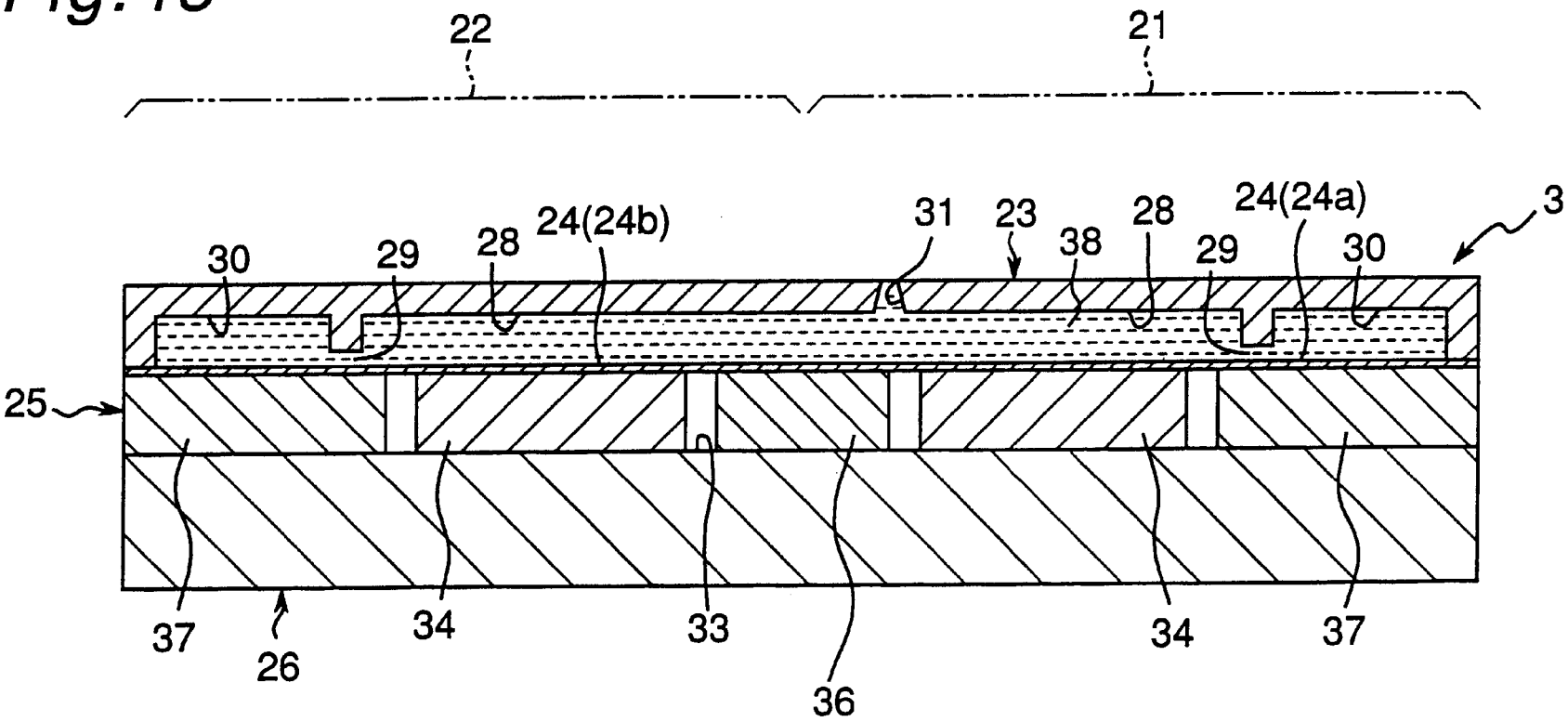
FIG. 43 is an enlarged cross sectional view of the ink-jet recording head in which the ink cavities in the first and second head portions are communicated.

Although, in the previous embodiments, the ink cavities are formed independently in the first and second head portions 21 and 22, the ink cavities in the first and second head portions on the same longitudinal line may be fluidly communicated each other as shown in FIG. 43. Also, only one nozzle 31 is provided for one pair of first and second piezoelectric members 34. Therefore, by selectively deforming the piezoelectric member in the first or second head portion 21 or 22, the ink droplet can be ejected from the nozzle 28. Thus, above described first to eighth embodiments can also be applied to this ink-jet head to form a halftone image.

Although the present invention has been fully described by way of examples with reference to the accompanying drawings, it is to be noted that various changes and modifications will be apparent to those skill in the art. Therefore, unless otherwise such changes and modifications depart from the scope of the present invention, they should be construed as being included therein.

What is claimed is:

1. An ink-jet recording device to selectively eject ink to form an image on a recording medium, said recording device comprising:

(a) a first wall member arranged adjacent to an ink material to be ejected;

(b) a second wall member arranged adjacent to an ink material to be ejected, said second wall member has an elasticity different from that of said first wall member;

(c) a first piezoelectric member arranged adjacent to said first wall member, said first wall member separating the first piezoelectric member from said ink material that is adjacent to said first wall member, said first piezoelectric member being deformable and adapted to deform said first wall member to eject an ink droplet of said ink material adjacent to said first wall member; and (d) a second piezoelectric member arranged adjacent said second wall member, said second wall member separating the second piezoelectric member from said ink material that is adjacent to said second wall member, said second piezoelectric member being deformable and adapted to deform said second wall member to eject an ink droplet of said ink material adjacent to said second wall member.

2. An ink-jet recording device claimed in claim 1, further comprising:

a first containing member which forms a first cavity with said first wall for containing said ink material; and a second containing member which forms a second cavity with said second wall for containing said ink material;

wherein said first containing member has a first opening for ejecting an ink droplet of said ink material from said first ink cavity in response to a deformation of said first piezoelectric member, and wherein said second containing member has a second opening for ejecting an ink droplet of said ink material from said second ink cavity in response to a deformation of said second piezoelectric member.

3. An ink-jet recording device claimed in claim 1, further comprising:

a containing member which forms an ink cavity with said first and second wall members;

wherein said containing member has an opening for ejecting an ink droplet of said ink material in said ink cavity by a deformation of said first or second piezoelectric member.

4. An ink-jet recording device claimed in claim 1, wherein an ink droplet ejected by a deformation of said first piezoelectric member differs in size from that ejected by a deformation of said second piezoelectric member.

5. An ink-jet recording method, comprising the steps of:

(a) ejecting an ink droplet of an ink material subject to an applied deformation of a first piezoelectric member by transmitting a deformation of said first piezoelectric member through a first wall into said ink material that is subject to an applied deformation of said first piezoelectric member; and (b) ejecting an ink droplet of an ink material subject to an applied deformation of a second piezoelectric member by transmitting a deformation of said second piezoelectric member through a second wall into said ink material that is subject to an applied deformation of said second piezoelectric member, said second wall having an elasticity different from that of said first wall;

wherein said ink droplet ejected at step (a) has a diameter different from that ejected at step (b), thereby forming dots having different diameters.

6. An ink-jet recording device to selectively eject ink to form an image on a recording medium, said recording device comprising:

(a) a first wall member arranged adjacent to an ink material to be ejected;

(b) a second wall member arranged adjacent to an ink material to be ejected, said second wall member having a thickness different from that of said first wall member;

(c) a first piezoelectric member arranged adjacent to said first wall member, said first wall member from said ink material that is adjacent to said second wall member, said first piezoelectric member being deformable and adapted to deform said first wall member to eject an ink droplet of said ink material adjacent to said first wall member; and (d) a second piezoelectric member arranged adjacent said second wall member, said second wall member separating the second piezoelectric member from said ink material that is adjacent to said second wall member, said second piezoelectric member being deformable and adapted to deform said second wall member to eject an ink droplet of said ink material adjacent to said second wall member;

wherein an ink droplet ejected by a deformation of said first piezoelectric member differs in size from that ejected by a deformation of said second piezoelectric member due to the respective thicknesses of said first and second wall members.

7. An ink-jet recording device claimed in claim 6, further comprising:

a first containing member which forms a first cavity with said first wall for containing said ink material; and a second containing member which forms a second cavity with said second wall for containing said ink material;

wherein said first containing member has a first opening for ejecting an ink droplet of said ink material from said first ink cavity in response to a deformation of said first piezoelectric member, and said second containing member has a second opening for ejecting an ink droplet of said ink material from said second ink cavity in response to a deformation of said second piezoelectric member.

8. An ink-jet recording device claimed in claim 6, further comprising:

a containing member which forms an ink cavity with said first and second wall members;

wherein said containing member has an opening for ejecting an ink droplet of said ink material in said ink cavity by a deformation of said first or second piezoelectric member.

9. An ink-jet recording method, comprising the steps of:

(a) ejecting an ink droplet of an ink material by transmitting a deformation of a first piezoelectric member through a first wall into said ink material; and (b) ejecting an ink droplet of an ink material by transmitting a deformation of a second piezoelectric member through a second wall into said ink material, said second wall having a thickness different from that of said first wall;

wherein said ink droplet ejected at step (a) has a diameter different from that ejected at step (b), thereby forming dots having different diameters.

10. An ink-jet recording method, comprising the steps of:

(a) ejecting an ink droplet of an ink material by transmitting a deformation of a first piezoelectric member into said ink material; and (b) ejecting an ink droplet of an ink material by transmitting a deformation of a second piezoelectric member into said ink material, said second piezoelectric member having a dimension which is different from that of said first piezoelectric member with respect to a direction perpendicular to a direction of deformation of said first and second piezoelectric members;

wherein said ink droplet ejected at step (a) has a diameter different from that ejected at step (b), thereby forming dots having different diameters.

11. An ink-jet recording device to selectively eject ink to form an image on a recording medium, said recording device comprising:

(a) retaining means for retaining an ink material to be ejected;

(b) a first piezoelectric member arranged adjacent to said retaining means, said first piezoelectric member being deformable and adapted to deform said retaining means to eject an ink droplet of said ink material; and (c) a second piezoelectric member arranged adjacent to said retaining means, said second piezoelectric member being deformable and adapted to deform said retaining means to eject an ink droplet of said ink material and having a dimension which is different from that of said first piezoelectric member with respect to a direction parallel to a deformation direction of said first and second piezoelectric members.

12. An ink-jet recording device claimed in claim 11, wherein said retaining means has a first cavity for retaining said ink material to be ejected by a deformation of said first piezoelectric member, a second cavity for retaining said ink material to be ejected by a deformation of said second piezoelectric member, and first and second openings through which ink droplets are ejected, respectively.

13. An ink-jet recording device claimed in claim 11, wherein said retaining means includes a cavity for retaining said ink material to be ejected by a deformation of said first piezoelectric member or said second piezoelectric member, and an opening through which an ink droplet is ejected.

14. An ink-jet recording device claimed in claim 11, wherein each of said first and second piezoelectric members is formed by superimposing a plurality of piezoelectric sheets, and the number of said piezoelectric sheets of said first piezoelectric member is different from that of said second piezoelectric member.

15. An ink-jet recording device claimed in claim 11, wherein an ink droplet ejected by a deformation of said first piezoelectric member differs in size from that ejected by a deformation of said second piezoelectric member.

16. An ink-jet recording method, comprising the steps of:

(a) ejecting an ink droplet of an ink material by transmitting a deformation of a first piezoelectric member into said ink material; and (b) ejecting an ink droplet of an ink material by transmitting a deformation of a second piezoelectric member into said ink material, said second piezoelectric member having a dimension which is different from that of said first piezoelectric member with respect to a direction parallel to a direction of deformation of said first and second piezoelectric members;

wherein said ink droplet ejected at step (a) has a diameter different from that ejected at step (b), thereby forming dots having different diameters.

17. An ink-jet recording device, comprising:

(a) retaining means for retaining an ink material to be ejected;

(b) piezoelectric means arranged adjacent to said retaining means, said piezoelectric means being capable of providing a deformation thereof when it receives an applied voltage, and said deformation being transmitted to said ink material in said retaining means to eject an ink droplet of said ink material; and (c) electrode means for supplying an applied voltage to said piezoelectric means, said electrode means being positioned relative to said piezoelectric means so as to supply said applied voltage to a first region and a second region of said electrode means, wherein a size of said first region differs from a size of said second region.

18. An ink-jet recording device claimed in claim 17, wherein said retaining means has a first cavity for retaining said ink material to be ejected by application of said applied voltage to said first region and a second cavity for retaining said ink material to be ejected by application of said applied voltage to said second region;

a first opening, through which said ink material in said first cavity is ejected, and a second opening, through which said ink material in said second ink cavity is ejected, wherein said piezoelectric means has a first piezoelectric member arranged adjacent to said first cavity and a second piezoelectric member arranged adjacent to said second ink cavity, and wherein said first region of said electrode means is provided on said first piezoelectric member and said second region of said electrode means is provided on said second piezoelectric member.

19. An ink-jet recording device claimed in claim 18, wherein said first opening for said first cavity has a diameter which is different from that of said second opening for said second cavity.

20. An ink-jet recording device claimed in claim 17, wherein said retaining means has an ink cavity for retaining said ink material to be ejected by application of said applied voltage to said first or second region of said electrode means, and an opening for ejecting said ink material.

21. An ink-jet recording device claimed in claim 17, wherein, due to said size of said first region relative to said second region, ink droplets ejected by application of said applied voltage to said first region differs in size from ink droplets ejected by application of said applied voltage to said second region.

22. An ink-jet recording method, comprising the steps of:

(a) ejecting an ink droplet of an ink material by transmitting a deformation of a first piezoelectric member to said ink material, said deformation of said first piezoelectric member being generated by applying a voltage to a first region of said piezoelectric member; and (b) ejecting an ink droplet of an ink material by transmitting a deformation of a second piezoelectric member to said ink material, said deformation of said second piezoelectric member being generated by applying a voltage to a second region of said piezoelectric member, said second region being different in size from said first region.

23. An ink-jet recording device, comprising:

(a) retaining means for retaining an ink material to be ejected;

(b) a first piezoelectric member arranged adjacent to said retaining means, said first piezoelectric member being deformable and adapted to deform said retaining means to eject an ink droplet of said ink material; and (c) a second piezoelectric member arranged adjacent to said retaining means, said second piezoelectric member being deformable and adapted to deform said retaining means to eject an ink droplet of said ink material, wherein said first and second piezoelectric members are polarized in different manners to establish different deformation characteristics in said first and second piezoelectric members to effect ink droplets having different ink volumes.

24. An ink-jet recording device claimed in claim 23, wherein said retaining means has a first cavity for retaining said ink material to be ejected by a deformation of said first piezoelectric member, a second cavity for retaining said ink material to be ejected by a deformation of said second piezoelectric member, and first and second openings through which ink droplets are ejected, respectively.

25. An ink-jet recording device claimed in claim 23, wherein said retaining means includes a cavity for retaining said ink material to be ejected by a deformation of said first piezoelectric member or said second piezoelectric member, and an opening through which an ink droplet is ejected.

26. An ink-jet recording device claimed in claim 23, wherein an ink droplet ejected by a deformation of said first piezoelectric member differs in size from that ejected by a deformation of said second piezoelectric member.

27. An ink-jet recording method, comprising the steps of:

(a) ejecting an ink droplet of an ink material by transmitting a deformation of a first piezoelectric member into said ink material; and (b) ejecting an ink droplet of an ink material by transmitting a deformation of a second piezoelectric member into said ink material, said second piezoelectric member having a piezoelectric constant which is different from that of said first piezoelectric member with respect to a direction parallel to a deformation direction of said first and second piezoelectric members;

wherein said ink droplet ejected at step (a) has a diameter different from that ejected at step (b), thereby forming dots having different diameters.

28. An ink-jet recording head, comprising:

(a) retaining means which includes a plurality of ink cavities for retaining an ink material and a plurality of openings, each of said ink openings being in fluid communication with at least one of said ink cavities; and (b) a plurality of piezoelectric members, each of which being adjacent to a corresponding ink cavity of said plurality of ink cavities, one group of said piezoelectric members being polarized differently from another group of said piezoelectric members, wherein the one group of said piezoelectric members has deformation characteristics that differ from those of said another group of said piezoelectric members.

29. A method for manufacturing an ink-jet recording head, comprising the steps of:

(a) providing a plurality of piezoelectric members on a substrate;

(b) providing a plurality of ink retaining means for retaining an ink material, each of said ink retaining means being arranged adjacent to a corresponding one of said plurality of piezoelectric members; and (c) polarizing said plurality of piezoelectric members to form one group of piezoelectric members having a first piezoelectric constant and a second group of piezoelectric members having a second piezoelectric constant, wherein said second piezoelectric constant is different from said first piezoelectric constant.

30. A method claimed in claim 29, wherein each of said piezoelectric members is bonded on said substrate with an adhesive capable of hardening under a temperature lower than a Curie point of a piezoelectric member.

31. A method claimed in claim 29, wherein said plurality of piezoelectric members is formed by bonding a piezoelectric plate on said substrate and then cutting said piezoelectric plate into said plurality of piezoelectric members.

32. An ink-jet recording device, comprising:

(a) retaining means for retaining an ink material to be ejected;

(b) first and second piezoelectric members arranged adjacent to said retaining means for providing said retaining means with respective deformations thereof to eject an ink droplet of said ink material;

(c) a first filler, positioned adjacent to at least one side of said first piezoelectric member, to resist deformation of said first piezoelectric member; and (d) a second filler, positioned adjacent to at least one side of said second piezoelectric member, to resist deformation of said second piezoelectric member, wherein said second filler is made of a material which is different from that of said first filler.

33. An ink-jet recording device claimed in claim 32, wherein said retaining means has a first cavity for retaining said ink material to be ejected by a deformation of said first piezoelectric member, a second cavity for retaining said ink material to be ejected by a deformation of said second piezoelectric member, and first and second openings through which ink droplets are ejected, respectively.

34. An ink-jet recording device claimed in claim 32, wherein said retaining means includes a cavity for retaining said ink material to be ejected by a deformation of said first piezoelectric member or said second piezoelectric member and an opening through which an ink droplet is ejected.

35. An ink-jet recording device claimed in claim 32, wherein an ink droplet ejected by a deformation of said first piezoelectric member differs in size from that ejected by a deformation of said second piezoelectric member due to a difference of materials of said first and second fillers.

36. An ink-jet recording method, comprising the steps of:

(a) ejecting an ink droplet of an ink material by transmitting a deformation of a first piezoelectric member into said ink material, said first piezoelectric member being sandwiched between a pair of first fillers; and (b) ejecting an ink droplet of an ink material by transmitting a deformation of a second piezoelectric member into said ink material, said second piezoelectric member being sandwiched between a pair of second fillers;

wherein a material of said pair of first fillers has an elasticity different than a material of said pair of second fillers; and wherein said ink droplet ejected at step (a) has a diameter different from that ejected at step (b), thereby forming dots having different diameters.

37. An ink-jet recording device, comprising:

(a) retaining means for retaining an ink material to be ejected;

(b) first and second piezoelectric members arranged adjacent to said retaining means for providing said retaining means with respective deformations thereof to eject an ink droplet of said ink material;

(c) a first filler, positioned adjacent to at least one side of said first piezoelectric member, to resist deformation of said first piezoelectric member; and (d) a second filler, positioned adjacent to at least one side of said second piezoelectric member, to resist deformation of said second piezoelectric member, wherein a thickness of said first filler, taken along a line perpendicular to a side of said first filler adjacent to said first piezoelectric member, is greater than a corresponding thickness of said second filler, and wherein the first filler and the second filler effect different physical characteristics of ink droplets respectively ejected by deformations of the first piezoelectric member and the second piezoelectric member.

38. An ink-jet recording device claimed in claim 37, wherein said retaining means has a first cavity for retaining said ink material to be ejected by a deformation of said first piezoelectric member, a second cavity for retaining said ink material to be ejected by a deformation of said second piezoelectric member, and first and second openings through which ink droplets are ejected, respectively.

39. An ink-jet recording device claimed in claim 37, wherein said retaining means includes a cavity for retaining said ink material to be ejected by said deformation of said first piezoelectric member or said second piezoelectric member and an opening through which an ink droplet is ejected.

40. An ink-jet recording device claimed in claim 37, wherein an ink droplet ejected by a deformation of said first piezoelectric member differs in size from that ejected by a deformation of said second piezoelectric member due to a difference of materials of said first and second fillers.

41. An ink-jet recording method, comprising the steps of:

(a) ejecting an ink droplet of an ink material by transmitting a deformation of a first piezoelectric member into said ink material, said first piezoelectric member being sandwiched between a pair of first fillers; and (b) ejecting an ink droplet of an ink material by transmitting a deformation of a second piezoelectric member into said ink material, said second piezoelectric member being sandwiched between a pair of second fillers, each of said second fillers having a width different from that of each of said first fillers;

wherein, due to a difference between a first filler width and a second filler width, said ink droplet ejected at step (a) has a diameter different from that ejected at step (b), thereby forming dots having different diameters.

42. An ink-jet recording method, comprising the steps of:

(a) ejecting an ink droplet of an ink material by transmitting a deformation of a first piezoelectric member into an ink material in a first passage; and (b) ejecting an ink droplet of an ink material by transmitting a deformation of a second piezoelectric member into said ink material in a second passage, wherein said first passage is not fluidly connected to said second passage, said second passage having a different fluid resistance from that of said first passage;

wherein said ink droplet ejected at step (a) has a diameter different from that ejected at step (b), thereby forming dots having different diameters.

43. An ink-jet recording head, comprising:

means for retaining an ink material which includes:

a first ink cavity and a first ink inlet, wherein said first ink inlet is fluidly connected to said first ink cavity and adapted to supply an ink material to said first ink cavity, and a second ink cavity and a second ink inlet, wherein said second ink inlet is fluidly connected to said second ink cavity and adapted to supply an ink material to said second ink cavity;

a first piezoelectric member, arranged adjacent to said first ink cavity, capable of providing a deformation to said ink material in said first ink cavity to eject an ink droplet of said ink material; and a second piezoelectric member, arranged adjacent to said second ink cavity, capable of providing a deformation to said ink material in said second ink cavity to eject an ink droplet of said ink material, wherein said first ink inlet has a first fluid resistance, said second ink inlet has a second fluid resistance, and said first fluid resistance is different from said second fluid resistance.

44. An ink-jet recording head claimed in claim 43, wherein a cross section of said first ink inlet differs from that of said second ink inlet.

45. An ink-jet recording head claimed in claim 43, wherein a length of said first ink inlet differs from that of said second ink inlet.

46. An ink-jet recording head claimed in claim 43, wherein said ink material retained in said first ink cavity is a first ink material, and said ink material retained in said second ink cavity is a second ink material, and wherein a property of said first ink material retained in said first ink cavity is different from a property of said second ink material in said second cavity.

47. An ink-jet recording head claimed in claim 46, wherein said property is color.

48. An ink-jet recording head claimed in claim 43, wherein ink droplets from said first ink cavity are a different size than ink droplets from said second cavity due to the respective fluid resistances of said first and second ink inlets.

* * * * *

UNITED STATES PATENT AND TRADEMARK OFFICE

CERTIFICATE OF CORRECTION

PATENT NO. : 6,305,791 B1
DATED : October 23, 2001
INVENTOR(S) : Hideo Hotomi et al.

It is certified that error appears in the above-identified patent and that said Letters Patent is hereby corrected as shown below:

Column 1,
Line 19, delete "extend", and insert -- extent --.
Line 23, delete "the", and insert -- a --.
Line 23, after "such as", insert -- a --.
Line 35, delete "printer", and insert -- printers --.
Line 38, delete "has", and insert -- have --.
Line 38, delete "property,", and insert -- properties --.
Line 40, delete "condition", and insert -- conditions --.
Line 62, delete "ensures", and insert -- allows --.

Figure 3A:
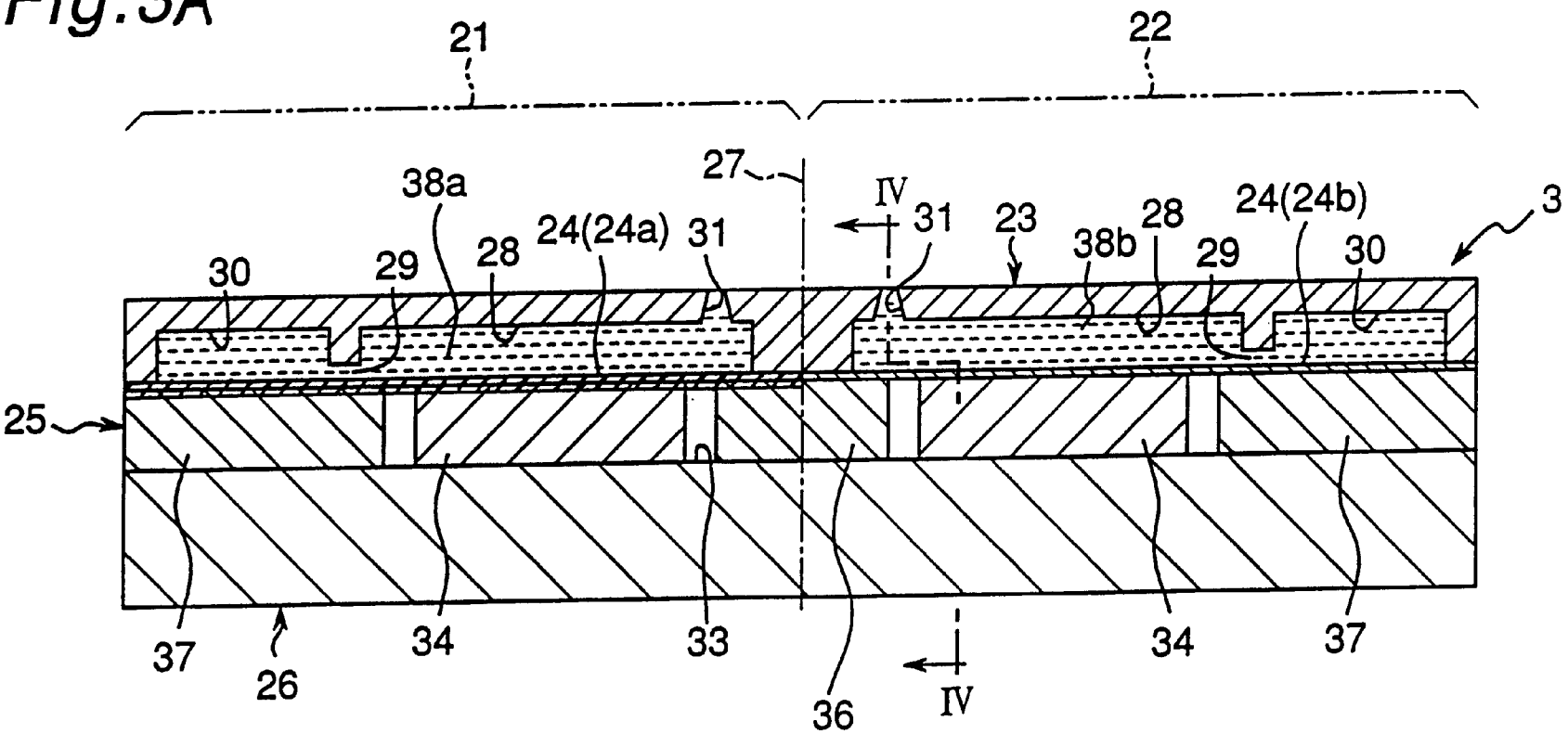

Column 2,
Line 2, after "the" and before "invention", insert -- present --.
Line 3, delete "the", and insert -- an --.
Line 4, after "head", delete ";", and insert -- of the ink jet recording device of Fig. 1; --.
Line 7, insert -- Fig. 3A is an enlarged cross sectional view of the ink-jet recording head taken along a line III-III in Fig. 2; --.
Line 14, delete the second instance of "the" and insert -- a --.
Line 19, delete "8", and insert -- 7 --.
Line 25, delete the second instance of "the" and insert -- a -- .
Line 52, delete "20", and insert -- 21 --.
Line 59, delete "the", and insert -- a --.

Column 3,
Line 2, delete "the", and insert -- a --.
Line 10, delete "the", and insert -- a --.
Line 19, delete the first instance of "the", and insert -- an --.
Line 39, delete "communicated", and insert -- in fluid communication --.
Line 63, delete "13," and insert -- 3, --.

Column 4,
Line 7, delete "8", and insert -- 9 --.
Line 7, delete "9", and insert -- 8 --.
Line 20, after the second occurrence of "and", insert -- are --.
Line 28, delete "symmetrically", and insert -- symmetrical --.
Line 36, delete "potions", and insert -- portions --.

UNITED STATES PATENT AND TRADEMARK OFFICE

CERTIFICATE OF CORRECTION

PATENT NO. : 6,305,791 B1
DATED : October 23, 2001
INVENTOR(S) : Hideo Hotomi et al.

It is certified that error appears in the above-identified patent and that said Letters Patent is hereby corrected as shown below:

Column 4,
Line 38, delete "communicated", and insert -- connected --.
Line 39, delete "a ink", and insert -- an ink --.
Lines 41-44, delete "of nozzles 31 fluidly communicating the ink cavities 28 to the atmosphere for ejecting the ink material in the ink cavities 28 through respective nozzles 31.", and insert -- of nozzles 31, fluidly connecting the ink cavities 28 and the atmosphere, to enable ejection of an ink material in the ink cavities 28. --.
Line 44, after "adjacent", insert -- to --.
Line 48, after "of", insert -- a --.
Line 49, delete "increases," and insert -- decreases --.
Line 51, delete "piece-electric", and insert -- piezoelectric --.
Line 62, delete "be communicated", and insert -- communicate --..
Line 63, delete "manner", and insert -- manners --.

Column 5,
Line 4, after "by", delete "a".
Lines 24 and 25, delete "is communicated", and insert -- communicates --.
Lines 26 and 27, delete "is in turn communicated", and insert -- communicates --.
Line 29, delete "are further communicated", and insert -- further communicates --.
Line 40, delete "date", and insert -- data --.
Line 47, delete "is", and insert -- are --.
Line 54, delete "the", and insert -- an --.
Line 56, delete "the", and insert -- an --.
Line 67, after "22", insert -- , Figure 3 and Figure 3A --.

Column 6,
Line 16, delete "the".
Line 24, delete "Test was", and insert -- Tests were --.
Lines 29 and 30, delete both instances of "micron meters", and insert for both instances -- microns --.
Line 30, delete the second instance of "micron meters", and insert -- microns --.
Line 31, delete both instances of "micron meters", and insert for both instances, -- microns --.
Line 32, delete "micron meters", and insert -- microns --.
Line 33, delete "micron meters", and insert -- microns --.
Line 34, delete "micron meters", and insert -- microns --.
Line 36, delete "micron meters", and insert -- microns --.
Lines 36 and 37, delete "micron meters", and insert -- microns --.

UNITED STATES PATENT AND TRADEMARK OFFICE

CERTIFICATE OF CORRECTION

PATENT NO. : 6,305,791 B1
DATED : October 23, 2001
INVENTOR(S) : Hideo Hotomi et al.

It is certified that error appears in the above-identified patent and that said Letters Patent is hereby corrected as shown below:

Column 6 cont'd.
Line 37, delete "micron meters", and insert -- microns --.
Lines 39 and 40, before "thickness", insert -- a --.
Line 40, delete "micron meters", and insert -- microns --.
Line 42, delete "100 micron seconds", and insert -- 100μs --.
Lines 48-50, delete "variation ranges of sizes of ink droplet and resultant ink dot due to the difference in elasticity or thickness thereof", and insert -- variable ranges of ink droplet sizes (and resultant ink dot diameters) due to the difference in elasticity of thickness of diaphragm 24, --.
Line 54, after "widely", insert -- as --.
Line 60, delete "micron meters", and insert -- microns --.
Line 62, delete both instances of "micron meters", and insert for both instances, -- microns --.

Column 7,
Line 5, after "groove", insert --32 --.
Line 6, after "member", insert -- 34 --.
Line 6, after "partition", insert -- 35, 37 --.
Lines 10 and 11, delete "variation range of the diameters of ink droplet and the resultant dot", and insert -- variable range of ink droplet sizes (and resultant ink dot diameters) --.
Line 18, delete "rage", and insert -- range --.
Line 28, delete "Test 1", and insert -- TEST 1 --.
Line 32, after "having", insert -- a --.
Line 32, delete "micron meters", and insert -- microns --.
Line 33, delete "micron meters", and insert -- microns --.
Line 35, delete "micron meters", and insert -- microns --.
Line 37, delete both instances of "micron meters", and insert -- microns --.
Lines 38 and 39, delete "micron meters", and insert -- microns --.
Line 45, delete "micron meters", and insert -- microns --.
Line 46, delete "30 micron seconds", and insert -- 30μs --.
Line 50, after "portion", insert -- 21 --.
Line 51, after "portion", insert -- 22 --.
Line 53, delete "Test 2", and insert -- TEST 2 --.
Lines 54 and 55, delete "micron meters", and insert --microns --.
Line 55, delete "micron meters", and insert -- microns --.

UNITED STATES PATENT AND TRADEMARK OFFICE

CERTIFICATE OF CORRECTION

PATENT NO. : 6,305,791 B1
DATED : October 23, 2001
INVENTOR(S) : Hideo Hotomi et al.

It is certified that error appears in the above-identified patent and that said Letters Patent is hereby corrected as shown below:

Column 8,
Lines 11 and 12, delete "in the form of".
Line 15, delete "of the".
Line 20, delete "342", and insert -- 341 --.
Line 21, delete "342", and insert --341 --.
Line 24, delete the first instance of "the".
Line 33, delete "is", and insert -- are --.
Line 58, delete "Test", and insert -- Tests --.
Line 61, delete "Test 1", and insert -- TEST 1--.
Line 63, delete "micron meters", and insert -- microns --.
Line 64, delete "micron meters", and insert -- microns --.
Line 66, delete "micron meters", and insert -- microns --.
Line 67, delete "micron meters was", and insert -- microns were --.

Column 9,
Line 3, delete "micron meters", and insert -- microns --.
Line 4, delete "micron meters", and insert -- microns --.
Lines 5 and 6, delete "micron meters", and insert -- microns --.
Line 12, delete "micron meters", and insert -- microns --.
Lines 13 and 14, delete "50 micron seconds", and insert -- 50μs --.
Line 15, delete "result is", and insert -- results are --.
Line 17, after "portion", insert -- 21 --.
Line 18, after "portion", insert -- 22 --.
Line 20, delete "Test 2", and insert -- TEST 2 --.
Lines 22 and 23, delete "micron meters", and insert -- microns --.
Line 23, delete "micron meters", and insert -- microns --.
Line 26, after "portions", delete "are".
Line 30, delete "portion", and insert -- portions --.
Line 32, delete "to".
Line 33, delete "to".
Line 42, delete "are applied with a voltage", and insert -- receive an applied voltage --.
Line 47, delete "to", and insert -- across --.

UNITED STATES PATENT AND TRADEMARK OFFICE

CERTIFICATE OF CORRECTION

PATENT NO. : 6,305,791 B1
DATED : October 23, 2001
INVENTOR(S) : Hideo Hotomi et al.

It is certified that error appears in the above-identified patent and that said Letters Patent is hereby corrected as shown below:

Column 10,
Line 13, delete "Test 1", and insert -- TEST 1 --.
Line 14, delete "micron meters", and insert -- microns --.
Line 15, delete "micron meters", and insert -- microns --.
Lines 15 and 16, delete "micron meters", and insert -- microns --.
Line 16, delete "height", and insert -- high --.
Line 16, delete "micron meters", and insert -- microns --.
Line 16, delete "width", and insert -- wide --.
Line 16, delete "The", and insert -- A --.
Lines 17 and 18, delete "micron meters", and insert -- microns --.
Line 19, delete "30 micron seconds", and insert -- 30μs --.
Line 29, delete "Test 2", and insert -- TEST 2 --.
Lines 30 and 31, delete "micron meters", and insert -- microns --.
Line 31, delete "micron meters", and insert -- microns --.
Line 33, delete "variation range of the diameter", and insert -- variable range of ink dot diameters --.
Line 40, delete "plarizations", and insert -- polarizations --.
Line 42, after "includes", insert -- the --.
Line 43, delete "an", and insert -- a --.
Line 45, delete "by", and insert -- with --.
Line 47, delete "by", and insert -- with --.
Line 53, delete "with", and insert -- while --.
Line 66, delete "is", and insert -- are --.

Column 11,
Line 1, delete "as", and insert -- because --.
Line 3, after "not", insert -- be --.
Line 29, delete "micron meters", and insert -- microns --.
Line 30, after "spaced", delete "by".
Line 30, delete "micron meters", and insert -- microns --.
Line 30, delete "each other", and insert -- an adjacent piezoelectric member --.
Lines 33 and 34, delete "the piezoelectric members for the first head portion with".
Line 35, delete "members", and insert -- piezoelectric members of the first portion --.
Line 38, after "the", delete "members", and insert -- piezoelectric members of --.
Line 40, delete "$X'=508x\ 10^{-12}(C/N)$.", and insert -- $x'=508x\ 10^{-12}(C/N)$. --.
Line 43, delete "$y = V \bullet X$", and insert -- $y = V \bullet x$ --.

UNITED STATES PATENT AND TRADEMARK OFFICE

CERTIFICATE OF CORRECTION

PATENT NO. : 6,305,791 B1
DATED : October 23, 2001
INVENTOR(S) : Hideo Hotomi et al.

It is certified that error appears in the above-identified patent and that said Letters Patent is hereby corrected as shown below:

Column 12,
Line 17, after "having", insert -- a --.
Line 24, after "elasticity", insert -- , --.
Line 27, after "portion" insert -- 22 --.
Line 40, delete "tradename", and insert -- trade name --.
Line 46, delete "micron meters", and insert -- microns --.
Line 55, delete both instances of "micron meters", and insert for both instances -- microns --.

Column 13,
Line 59, delete "micron meters", and insert -- microns --.
Line 61, delete "micron meters", and insert -- microns --.
Line 62, delete "micron meters", and insert -- microns --.

Column 14,
Line 22, delete both instances of "micron meters", and insert for both instances -- microns --.
Line 28, delete "sizes of dots", and insert -- of dot sizes --.
Line 41, delete "micron meters", and insert -- microns, respectively --.
Lines 42 and 43, delete "resistance to be received by the ink", and insert -- resistance of the ink --.
Line 44, delete "potion", and insert -- portion --.
Lines 44 and 45, delete "to be received by", and insert -- of --.

Column 15,
Line 11, delete both instances of "micron meters", and insert for both instances -- microns --.
Line 35, delete both instances of "micron meters", and insert for both instances, -- microns --.
Line 37, delete "micron meters", and insert -- microns --.
Line 38, after "inlet", delete ",".
Line 39, after "same", delete ", respectively".
Line 41, delete "respective".
Line 45, delete "micron meters", and insert -- microns --.
Line 46, delete "micron meters", and insert -- microns --.
Line 61, after "as", insert -- a --.
Line 66, delete "is penetrated", and insert -- penetrates --.

UNITED STATES PATENT AND TRADEMARK OFFICE

CERTIFICATE OF CORRECTION

PATENT NO. : 6,305,791 B1
DATED : October 23, 2001
INVENTOR(S) : Hideo Hotomi et al.

It is certified that error appears in the above-identified patent and that said Letters Patent is hereby corrected as shown below:

Column 16,
Line 1, after "contact", delete "with".
Line 19, delete "which", and insert -- thus --.
Line 24, delete "communicated", and insert -- connected to --.
Line 29, delete "28", and insert -- 31 --.

Column 17,
Lines 52 and 53, delete "said first wall member from said ink material that is adjacent to said second", and insert -- said first wall member separating the first piezoelectric member from said ink material that is adjacent to said first --.

Column 24,
Lines 42-44, delete "first ink material retained in said first ink cavity is different from a property of said second ink material in said second cavity.", and insert -- first ink material is different from a property of said second ink material. --.

Signed and Sealed this

Sixth Day of August, 2002

*Attest:*

*Attesting Officer*

JAMES E. ROGAN
*Director of the United States Patent and Trademark Office*